US012702903B2

(12) United States Patent
Schier et al.

(10) Patent No.: US 12,702,903 B2
(45) Date of Patent: Aug. 11, 2026

(54) GOLF CLUB HEAD WITH LOW CG AND HIGH MOI

(71) Applicant: KARSTEN MANUFACTURING CORPORATION, Phoenix, AZ (US)

(72) Inventors: Matthew T. Schier, Phoenix, AZ (US); Travis D. Milleman, Cave Creek, AZ (US); Eric J. Morales, Laveen, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 310 days.

(21) Appl. No.: 18/504,149

(22) Filed: Nov. 7, 2023

(65) Prior Publication Data

US 2024/0149118 A1 May 9, 2024

Related U.S. Application Data

(60) Provisional application No. 63/501,498, filed on May 11, 2023, provisional application No. 63/382,682, filed on Nov. 7, 2022.

(51) Int. Cl.
*A63B 53/04* (2015.01)

(52) U.S. Cl.
CPC ..... *A63B 53/0437* (2020.08); *A63B 53/0466* (2013.01); *A63B 2053/0491* (2013.01)

(58) Field of Classification Search
CPC ..... A63B 53/0437; A63B 53/0466
See application file for complete search history.

(56) References Cited

U.S. PATENT DOCUMENTS

| | | | | |
|---|---|---|---|---|
| 5,851,160 | A | 12/1998 | Rugge | |
| 7,297,074 | B2 | 11/2007 | Kumamoto | |
| 9,211,451 | B1 | 12/2015 | Westrum | |
| 10,322,319 | B2 | 6/2019 | Del Rosario | |
| 11,654,336 | B2 | 5/2023 | Penney | |
| 2006/0052185 | A1 | 3/2006 | Kawaguchi | |
| 2010/0144462 | A1* | 6/2010 | Dawson | A63B 53/0466 473/345 |
| 2010/0160075 | A1 | 6/2010 | Dawson | |
| 2016/0346640 | A1 | 12/2016 | Boggs | |
| 2018/0185721 | A1 | 7/2018 | Hettinger | |
| 2019/0046845 | A1* | 2/2019 | Greensmith | A63B 53/06 |
| 2019/0176001 | A1* | 6/2019 | Jertson | A63B 53/08 |
| 2021/0138315 | A1 | 5/2021 | Boggs | |
| 2021/0187369 | A1 | 6/2021 | Milleman | |
| 2022/0219049 | A1 | 7/2022 | Cleghorn | |
| 2023/0047267 | A1 | 2/2023 | Reed | |

FOREIGN PATENT DOCUMENTS

| | | |
|---|---|---|
| JP | 2008246082 | 10/2008 |
| JP | 6188759 | 8/2017 |

* cited by examiner

*Primary Examiner* — Raeann Gorden

(57) ABSTRACT

A hybrid-type club head golf club head having dual-purpose mass pads which simultaneously increase perimeter weighting and discretionary mass by forming at least a portion of a lap joint. A crown insert is coupled to the lap joint and thereby coupled to a portion of the dual-purpose mass pad. The dual-purpose mass pads improve an Iyy/CGy ratio to achieve a higher launch and spin, thereby improving stopping power on approach shots into the green.

18 Claims, 21 Drawing Sheets

GOLF CLUB HEAD WITH LOW CG AND HIGH MOI

CROSS REFERENCE PRIORITIES

This claims the benefit of U.S. Provisional Application No. 63/501,498 filed May 11, 2023, and U.S. Provisional Application 63/382,682 filed on Nov. 7, 2022, the contents of which are fully incorporated herein by reference.

TECHNICAL FIELD

This disclosure relates generally to golf equipment and, more particularly, relates to golf club heads with improved mass properties achieved through various mass pad arrangements and weight saving features.

BACKGROUND

Hybrid type golf club heads are designed to bridge the yardage gap between fairway type club heads and long irons. They further are a nice alternative club to irons for golfers that sweep the ball rather drive down contact on the ball. As such, hybrids typically are used to hit longer shots to the green. In general, prior-art hybrids are designed to prioritize forgiveness (by providing perimeter weighting to increase MOI) and/or distance (by delofting the club head). As such, the issue is hybrids are harder to high and spin which tend to produce shots with lower launch, lower spin, and lower peak height. While a lower launch can be advantageous for increasing distance, the golfer loses the ability to stop the ball on the green on approach shots (i.e., the club head loses "stopping power").

Furthermore, golf club designers are constantly balancing the center of gravity (CG) position with the MOI of the club head. Specifically, there is an inherent tradeoff between the CG height and MOI about a vertical axis, or heel-toe moment of inertia. A lower CG height can produce desirable launch characteristics such as launch angle, ball speed, and spin. A lower CG height, however, also lowers the heel-toe moment of inertia, which reduces forgiveness. Raising CG height increases the moment of inertia, but at the sacrifice of launch characteristics. As such, designers have been balancing the CG height and heel-toe moment of inertia according to design goals and skill level of the target player. Therefore, there is a need in the art for a higher launching and spinning hybrid while still maintaining or increasing distance (i.e., improved stopping power with same or more distance).

BRIEF DESCRIPTION OF THE DRAWINGS

To facilitate further description of the invention, the following drawings are provided in which.

Figure 1:
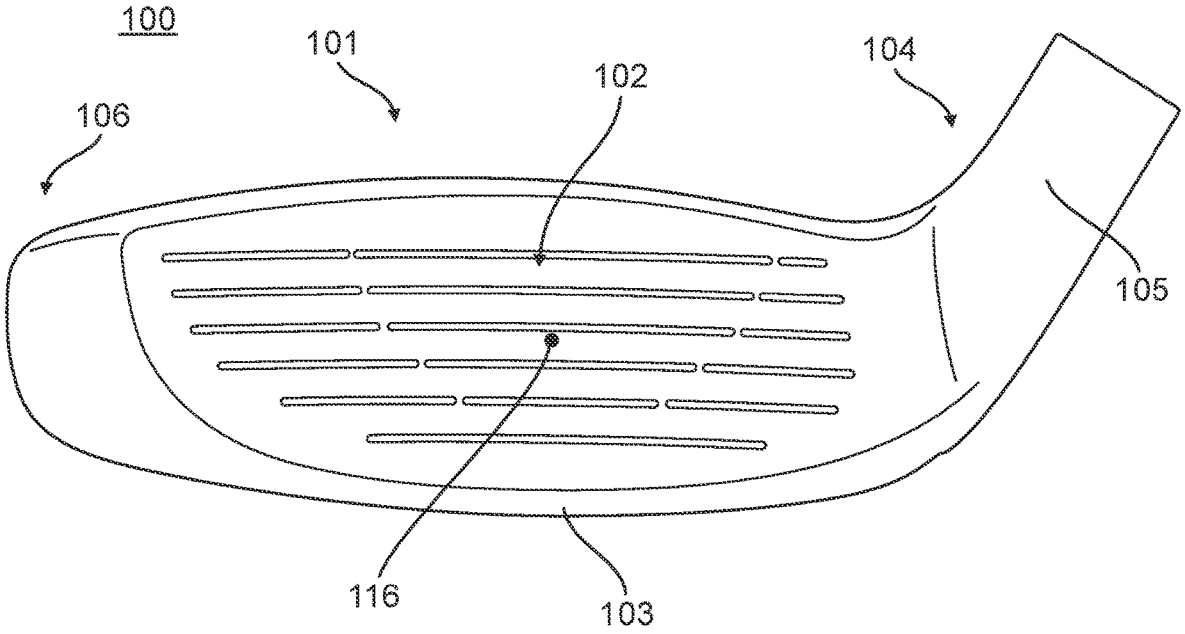
FIG. 1 illustrates a front view of a golf club head according to this disclosure.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

Definitions

Described herein is a hybrid-type golf club head comprising dual purpose mass pads which achieve higher launch and peak height while maintaining or increasing carry distance. Increasing the peak height improves stopping power on approach shots into the green. While a higher launch angle typically reduces carry distance, the hybrid-type golf club heads described herein maintain or increase carry distance by improving mass properties and face flexure, which increase ball speed. In other words, the hybrid-type golf club head achieves higher launch and stopping power while maintaining or increasing carry distance by improving the Iyy/CGy ratio. The hybrid-type golf club head comprising dual purpose mass pads improve the Iyy/CGy ratio by 1) moving mass to the further periphery portions of the club head (i.e., the lap joint in the skirt) and 2) increasing discretionary mass by removing the need for a separate and dedicated lap joint structure.

The terms "first," "second," "third," "fourth," and the like, as used herein, distinguish between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like, as used herein, are merely descriptive and do not necessarily describe permanent relative positions. It is to be understood that the terms so used are interchangeable under appropriate circumstances such that the embodiments of the invention described herein are, for example, capable of operation in orientations other than those illustrated or otherwise described herein.

The terms "couple," "coupled," "couples," "coupling," and the like, as used herein, broadly refer to connecting two or more elements or signals, electrically, mechanically and/or otherwise.

The term "stat area," as used herein, defines a projected dispersion of a set of golf shots using a 90% 2-D confidence ellipse (herein "the ellipse"). The center of the ellipse is defined by the average of the downline and offline distances of all of the golf shots in the set. One of the ellipse radii is defined as the standard deviation in the downline direction and the other radii is defined as the standard deviation in the offline direction. The area of the ellipse is the stat area. A smaller stat area represents a tighter dispersion of the set of golf shots and therefore is indicative of a golf club having a greater accuracy.

FIGS. 1-9 schematically illustrate various embodiments of a hybrid-type golf club head in various views. The features discussed below are demonstrated on club head 100. For ease of discussion, the features shown on club head 100 are applicable to various embodiments of the club head according to the present invention. Any one or more of the features described in the various embodiments below can be used in combination with one another. Further, any one or more of the features described below can be used on a fairway-type golf club head.

The club head 100 can comprise a strike face 102 and a body 101 secured together to define a substantially closed/hollow interior cavity. The club head 100 comprises a crown 110, a sole 112 opposite the crown 110, a heel 104, a toe 106 opposite the heel 104, a front end 108, and a rear end 111*a* opposite the front end 108. The body 101 can further include a skirt 114 and/or a trailing edge 109 located between and adjoining the crown 110 and the sole 112. The skirt 114 can extend from near the heel 104 to near the toe 106 of the club head 100. The club head further comprises a leading edge 103 located at the front end 108.

A "hybrid-type golf club head," also referred to as a hybrid, as described herein, can be defined by specific dimensional ranges. In particular, the hybrid, as described with regard to the invention disclosed herein, includes a loft angle and a volume.

The "loft angle" of the hybrid can range from approximately 15 degrees to 37 degrees. For example, the loft angle can range between approximately 16 degrees and 36 degrees. The loft angle can be approximately 15 degrees, 16, degrees, 17 degrees, 18 degrees, 19 degrees, 20 degrees, 21 degrees, 22 degrees, 23 degrees, 24 degrees, 25 degrees, 26 degrees, 27 degrees, 28 degrees, 29 degrees, 30 degrees, 31 degrees, 32 degrees, 33 degrees, 34 degrees, 35 degrees, 36 degrees, or 37 degrees.

The volume of the hybrid can range from approximately 100 $cm^3$ to 160 $cm^3$. The volume of the hybrid can range from approximately 100 $cm^3$ to 120 $cm^3$, 120 $cm^3$ to 140 $cm^3$, or 140 $cm^3$ to 160 $cm^3$. The volume of the hybrid can be approximately 100 $cm^3$, 105 $cm^3$, 110 $cm^3$, 115 $cm^3$, 120 $cm^3$, 125 $cm^3$, 130 $cm^3$, 135 $cm^3$, 140 $cm^3$, 145 $cm^3$, 150 $cm^3$, 155 $cm^3$, or 160 $cm^3$.

A "fairway-type golf club head," also referred to as a fairway wood, as used herein, can be defined by specific dimensional ranges. In particular, the fairway wood includes a loft angle and a volume.

The "loft angle" of the fairway-type club head as defined herein can be less than approximately 35 degrees, less than approximately 34 degrees, less than approximately 33 degrees, less than approximately 32 degrees, less than approximately 31 degrees, or less than approximately 30 degrees. In some embodiments, the loft angle of the fairway-type golf club head can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the fairway-type golf club head can be between 14 degrees and 35 degrees, between 15 degrees and 35 degrees, between 20 degrees and 35 degrees, or between 12 degrees and 30 degrees.

The "volume" of the fairway-type club as described herein can be less than approximately 170 $cm^3$, less than approximately 180 $cm^3$, less than approximately 190 $cm^3$, or less than approximately 200 $cm^3$. However, the volume of the fairway-type club cannot be less than 160 $cm^3$. In some embodiments, the volume of the fairway-type club head can be between approximately 150 $cm^3$ to 200 $cm^3$, between approximately 160 $cm^3$ to 170 $cm^3$, between approximately 160 $cm^3$ to 180 $cm^3$, or between approximately 170 $cm^3$ to 190 $cm^3$. The volume of the fairway-type club cannot be greater than 200 $cm^3$. In one exemplary embodiment, the volume of the fairway-type club is 169 $cm^3$.

The club head 100 can comprise one or more body materials such as steel, stainless steel, tungsten, aluminum, titanium, vanadium, chromium, cobalt, nickel, other metals, or metal alloys. In some embodiments, the body material can comprise a Ti-8Al-1Mo-1V alloy, or a 17-4 stainless steel. In some embodiments, the body material can be formed from C300, C350, Ni (Nickel)-Co(Cobalt)-Cr(Chromium)-Steel Alloy, 565 Steel, AISI type 304 or AISI type 630 stainless steel, 17-4 stainless steel, a titanium alloy, for example, but not limited to Ti-6-4, Ti-3-8-6-4-4, Ti-10-2-3, Ti 15-3-3-3, Ti 15-5-3, Ti185, Ti 6-6-2, Ti-7s, Ti-9s, Ti- 92, or Ti-8-1-1 titanium alloy, an amorphous metal alloy, or other similar metals. In some embodiments, one or more portions of the club head 100 can comprise a non-metallic material.

Club Orientation and Statics

Figure 2:
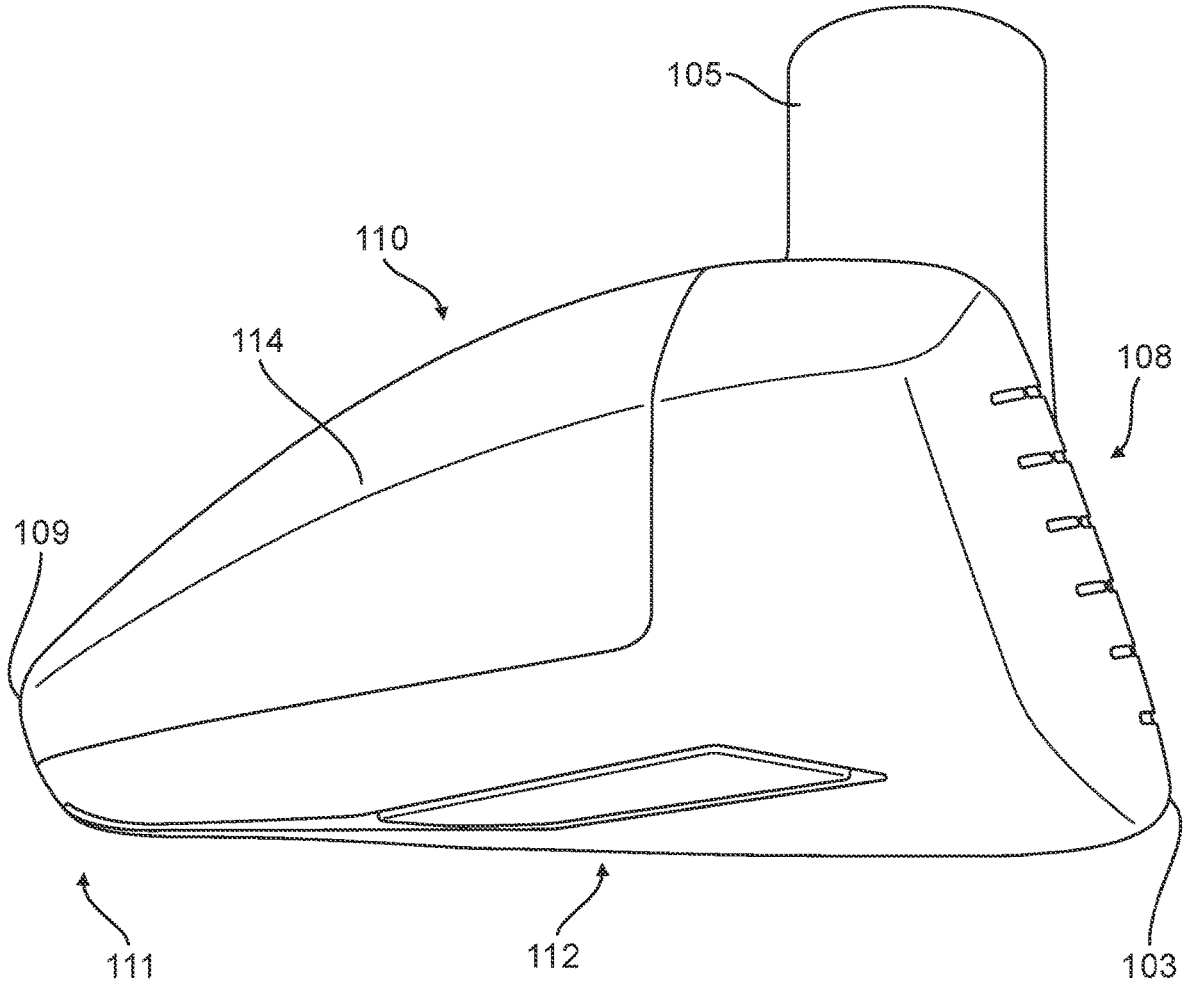
FIG. 2 illustrates a toe side view of the golf club head of FIG. 1.

The "ground plane," as used herein, refers to a reference plane associated with the surface on which a golf ball is placed. The ground plane 1010 can be a horizontal plane tangent to the sole at an address position. Address position is defined in further detail below. The ground plane 1010 is illustrated in FIG. 2.

Figure 3:
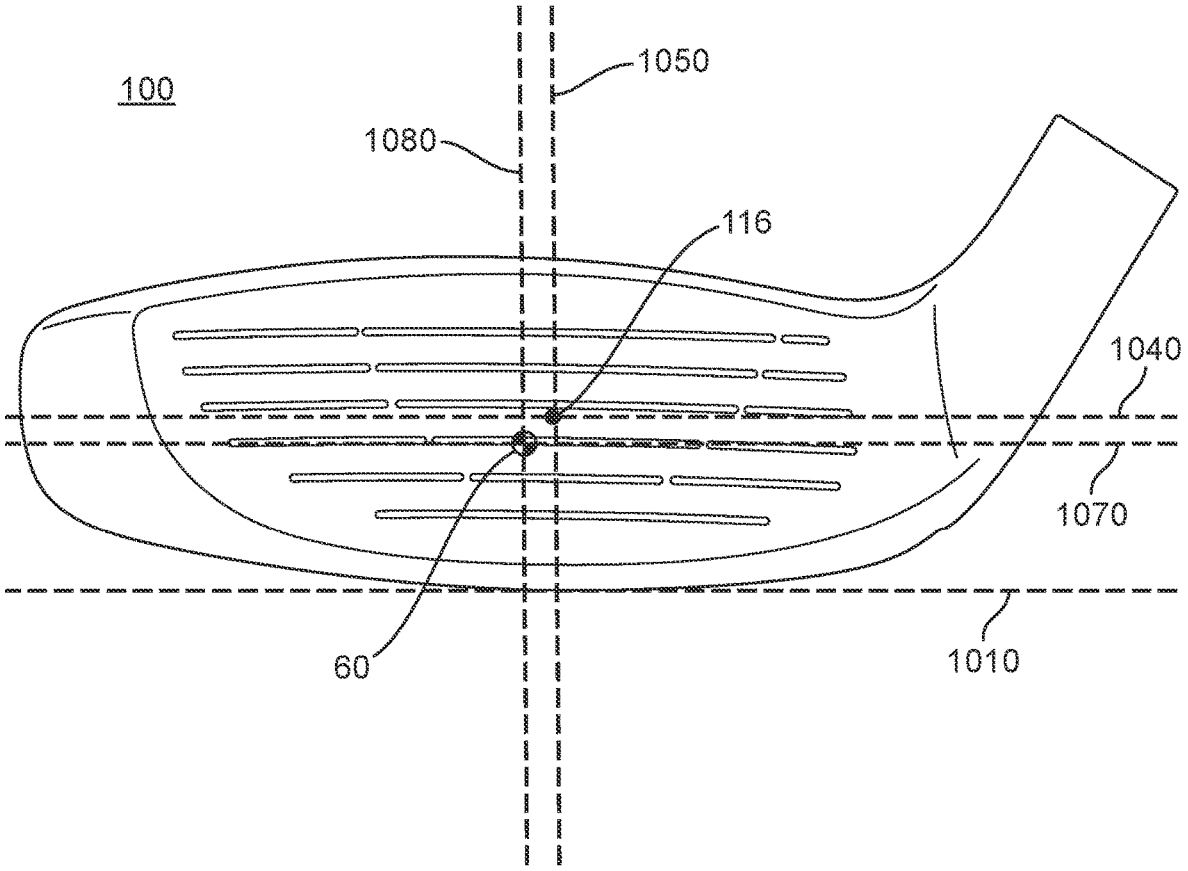
FIG. 3 illustrates a front view of the golf club head of FIG. 1.

The "loft plane," as used herein, refers to a reference plane that is tangent to a geometric center of the strike face (the "geometric center" is described in further detail below). Loft plane 1015 is illustrated in FIG. 3.

The term "loft angle," as used herein, can refer to an angle measured between the loft plane 1015 and the XY plane (defined below). Loft angle 10 is illustrated in FIG. 3.

The club head 100 can define an "address position" (also referred to as "address"), and is used herein as the orientation of the club head such that club head forms its intended loft angle 10 and lie angle. For example, at address position, the loft plane 1015 and an XY plane form the intended loft angle 10 between one another. Likewise, at address position, the hosel axis and the ground plane 1010 form the intended lie angle between one another.

The term "lie angle," as used herein, can refer to an angle between a hosel axis, extending through the hosel, and the ground plane. The lie angle is measured from a front view.

The "depth" of the golf club head, as used herein, can be defined as a front-to-rear dimension of the golf club head.

The "height" of the golf club head, as used herein, can be defined as a crown-to-sole dimension of the golf club head. In many embodiments, the height of the club head can be measured according to a golf governing body such as the United States Golf Association (USGA).

The "length" of the golf club head, as used herein, can be defined as a heel-to-toe dimension of the golf club head. In many embodiments, the length of the club head can be measured according to a golf governing body such as the United States Golf Association (USGA).

The "geometric center height" of the fairway-type golf club head, as used herein, is a height measured perpendicular from the ground plane to the geometric centerpoint of the golf club head.

The "leading edge" of the club head, as used herein, can be identified as the most sole-ward portion of the strike face perimeter.

Figure 4:
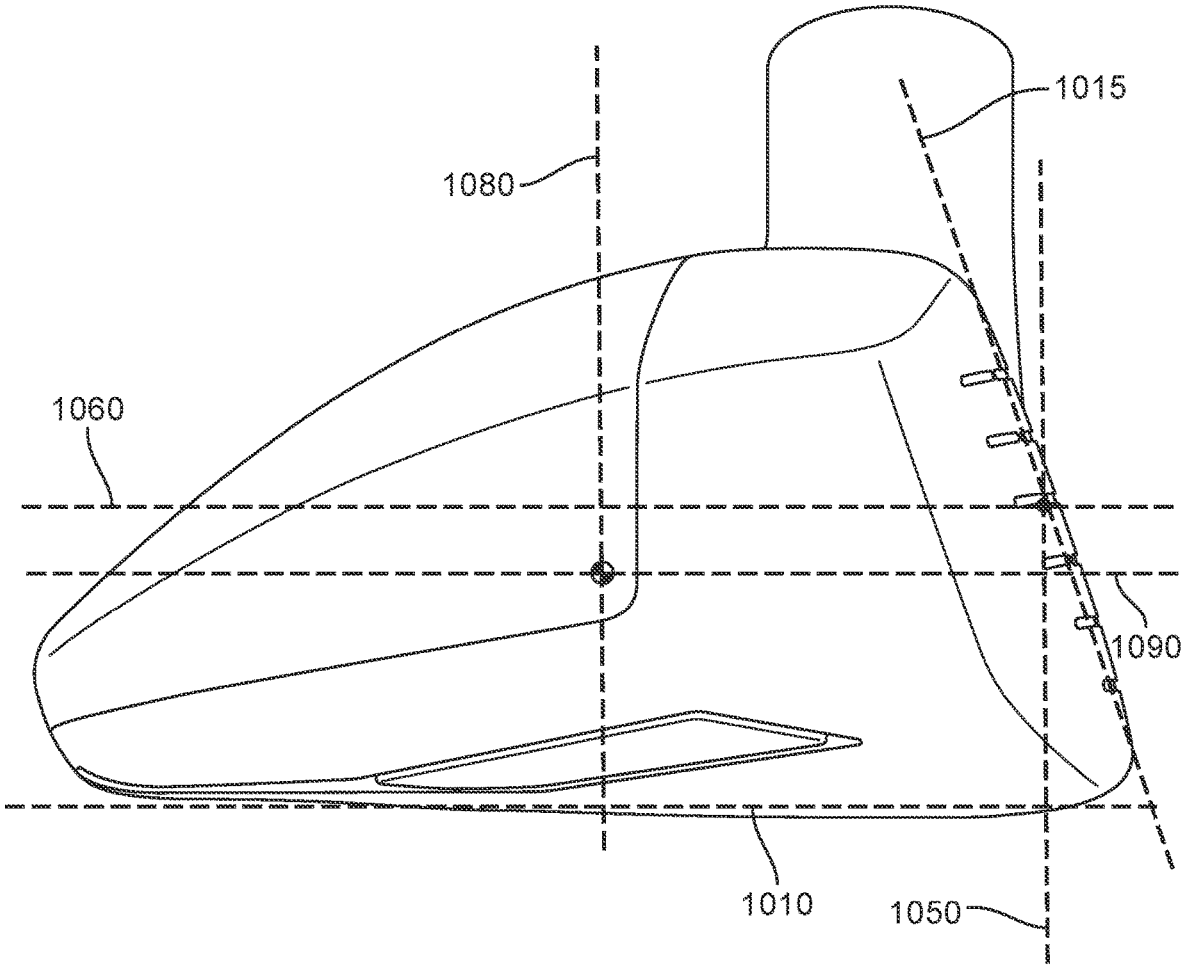
FIG. 4 illustrates a toe side view of the golf club head of FIG. 1.

As illustrated in FIGS. 3 and 4, the club head 100 as used herein, has a primary coordinate system centered about the geometric center 116 of the strike face 102. The primary coordinate system can comprise an X-axis 1040, a Y-axis 1050, and a Z-axis 1060 (see FIG. 4). The X-axis 1040 can extend in a heel-to-toe direction, parallel to the ground plane 1010. The positive X-axis 1040 extends from the geometric center 116 towards the heel 104. The negative X-axis 1040 extends from the geometric center 116 towards the toe 106. The Y-axis 1050 can extend in a crown-to-sole direction and can be orthogonal to both the ground plane 1010 and the X-axis 1040. The positive Y-axis 1050 extends from the geometric center 116 towards the crown 110. The negative Y-axis 1050 extends from the geometric center towards the sole 112. The Z-axis 1060 can extend in front-to-rear direction, parallel to the ground plane 1010, and can be orthogonal to both the X-axis 1040 and the Y-axis 1050. The positive Z-axis 1060 extends from the geometric center 116 towards the strike face 102. The negative Z-axis 1060 extends from the geometric center 116 towards the rear end 111*a*.

The primary coordinate system, as used herein, defines an XY plane as a vertical plane extending along the X-axis 1040 and the Y-axis 1050. The primary coordinate system defines an XZ plane as a horizontal plane extending along the X-axis 1040 and the Z-axis 1060. The primary coordinate system further defines a YZ plane as a vertical plane extending along the Y-axis 1050 and the Z-axis 1060. The XY plane, the XZ plane, and the YZ plane are all perpendicular to one another and intersect at the primary coordinate system origin located at the geometric center 116 of the strike face 102. In these or other embodiments, the club head 100 can be viewed from a front view when the strike face 102 is viewed from a direction perpendicular to the XY plane. Further, in these or other embodiments, the club head 100 can be viewed from a side view or side cross-sectional view when the heel 104 or toe 106 is viewed from a direction perpendicular to the YZ plane.

The "center of gravity" or "CG" of the club head, as used herein, can refer to the point at which the mass is centered within the club head. The center of gravity 60 is illustrated in FIGS. 3 and 4.

The term or phrase "center of gravity position" or "CG location" can refer to the location of the club head center of gravity (CG) with respect to the primary coordinate system, wherein the CG position is characterized by locations along the X-axis 1040, the Y-axis 1050, and the Z-axis 1060. The term "CGx" can refer to the CG location along the X-axis 1040, measured from the geometric center 116. The term "CG height" can refer to the CG location along the Y-axis 1050, measured from the geometric center 116. The term "CGy" can be synonymous with the CG height. The term "CG depth" can refer to the CG location along the Z-axis 1060, measured from the geometric center 116. The term "CGz" can be synonymous with the CG depth. The term "Ygp" can refer to the CG location along Y-axis 1050, measured from the ground plane 1010.

The golf club head further comprises a secondary coordinate system centered about the center of gravity 60. As illustrated in FIGS. 3 and 4, the secondary coordinate system comprises an X'-axis 1070, a Y'-axis 1080, and a Z'-axis 1090. The X'-axis 1070 extends in a heel-to-toe direction. The positive X'-axis 1070 extends from the CG 60 towards the heel 104. The negative X'-axis 1070 extends from the CG 60 towards the toe 106. The Y'-axis 1080 extends in a sole-to-crown direction and is orthogonal to both the Z'-axis 1090 and the X'-axis 1070. The positive Y'-axis 1080 extends from the CG 60 towards the crown 110. The negative Y'-axis extends from the CG 60 towards the sole 112. The Z'-axis 1090 extends front-to-rear, parallel to the ground plane 1010 and is orthogonal to both the X'-axis 1070 and the Y'-axis 1080. The positive Z'-axis 1090 extends from the CG 60 towards the strike face 102. The negative Z'-axis 1090 extends from the CG 60 towards the rear end 111*a*.

The term or phrase "moment of inertia" (hereafter "MOI") can refer to a value derived using the center of gravity (CG) location.

MOI is a measurement of an object's resistance to twisting about a given axis and is calculated according to Equation 1 below.

$$I=\int r^2 dm \quad \text{(Eqn. 1)}$$

Equation 1 defines MOI, represented by I, of an object as the integral, with respect to mass (represented by dm), of the perpendicular distance between the axis about which MOI is being measured and the location of the mass of the object, represented by r, squared. It is generally known that, if the center of gravity (CG) of an object is known, that object may be treated as a point mass located at said CG. Treating an object as a point mass allows Equation 1 to be simplified to the following equation, Equation 2.

$$I = \sum m_i r_i^2 \quad \text{(Eqn. 2)}$$

Equation 2 describes that the moment of inertia, I, of an object about a given axis is equal to the sum of the masses of all point masses of that object multiplied by the perpendicular distance between the axis about which MOI is being measured and each of the point masses.

The term "MOIxx" or "Ixx" can refer to the MOI measured about the X'-axis 1070. The term "MOIyy" or "Iyy" can refer to the MOI measured about the Y'-axis 1080. The term "MOIzz" or "Izz" can refer to the MOI measured about the Z'-axis 1090. The MOI values MOIxx, MOIyy, and MOIzz determine how forgiving the club head 100 is for off-center impacts with a golf ball.

DESCRIPTION

Described herein is a hybrid-type golf club head having higher launch, spin, and peak height while maintaining or increasing carry distance. Increasing the peak height improves stopping power on approach shots into the green. While a higher launch angle typically reduces carry distance, the hybrid-type golf club heads described herein maintain or increase carry distance by improving mass properties and face flexure, for increased ball speed. In other words, the hybrid-type golf club head achieves higher launch and stopping power while maintaining or increasing carry distance by improving the Iyy/CGy ratio.

One or more mass pads have locations and profiles that improve an Iyy/CGy ratio. More specifically, the mass pad configuration drives the CGy lower without negatively lowering Iyy. As mentioned above, typically Iyy is reduced as CGy is lowered as mass moves within a golf club head. The mass pad configuration described herein, however, lowers CGy while maintaining Iyy, resulting in a higher launch angle with the same or increased carry distance. Additionally, the mass pad profiles facilitate fabrication and assembly of the components of the golf club head.

The hybrid-type golf club head may comprise additional features to be used in combination with the mass pad configuration to further improve the Iyy/CGy ratio. For example, in some embodiments, the hybrid-type golf club head may comprise a shorter and thinner strike face, increased loft, an open hosel, or other various features or combination of features, which can improve discretionary mass, increase face flexure, and/or increase launch angle.

I. Mass Pad

1. Relationships

The golf club head can comprise at least one mass pad forming a portion of the lap joint. The golf club head, for example, can be golf club head 100 which is a hybrid-type golf club head. The golf club head 100 comprises multiple weight components that are configured and arranged to lower CGy while increasing Iyy. For example, as best shown in FIGS. 14-20, the golf club head 100 includes a rear mass pad 124, a sole mass pad 132, a toe mass pad 128, a heel mass pad 138, and a removable weight 193. The rear mass pad 124 extends around a skirt 114 of the golf club head 100, including the rearward most portion of the club head 100, to increase Iyy while lowering CGy. The sole mass pad 132 and removable weight 193 primarily lower CGy by providing discretionary mass proximate the sole of the club head. The heel mass pad 138 and toe mass pad 128 primarily increase Iyy by providing discretionary mass towards the periphery of the club head. Together, the rear mass pad 124, sole mass pad 132, toe mass pad 128, heel mass pad 138, and removable weight 193 help improve the Iyy/CGy ratio by either having a lower CG for the same Iyy or increasing Iyy for the same CGy value.

As shown in FIGS. 14-19, an outer surface of the rear mass pad 124 and toe mass pad 128 is recessed to form a portion of a lap joint in the rear for directly adhering a crown panel 150. Adhering the crown panel directly to the rear mass pad 124 eliminates the need for a separate, dedicated lap joint structure (and thereby wasted weight for this structure) in the rear, thereby increasing discretionary mass that can be located in the club head periphery or located proximate the sole to improve and address the quandary of lower CGy, but retaining and/or increasing Iyy thus increasing the Iyy/CGy ratio. For example, the additional discretionary mass can be added to the sole mass pad, toe mass pad, heel mass pad, and/or removable weight. The cohesive lap joint mass pad structure wherein the mass pads are dual purpose meaning they form a portion of the lap joint and retain mass proximate the sole and periphery lowers CGy and retains and/or increases Iyy.

The toe mass and rear mass pad which form a portion of the lap joint surface improve the Iyy/CGy ratio by 1) moving mass to the further periphery portions of the club head (i.e., the lap joint in the skirt) and 2) increasing discretionary mass by removing the need for a separate and dedicated lap joint structure. The Iyy/CGy ratio can further be improved by utilizing other various mass saving features as well as features which affect launch characteristics, all of which are described herein.

The golf club head, such as club head 100, having dual-purpose mass pads which form a portion of the lap joint has an improved Iyy/CGy ratio such that the club head satisfies the following inequality:

$$Iyy \geq 20.275 * CGy + 373.46$$

The golf club head 100 can comprise an Iyy ranging from 255 kg*mm$^2$ to 300 kg*mm$^2$. In some embodiments, the Iyy can range from 255 kg*mm$^2$ to 265 kg*mm$^2$, 265 kg*mm$^2$ to 275 kg*mm$^2$, 275 kg*mm$^2$ to 285 kg*mm$^2$, or 285 kg*mm$^2$ to 300 kg*mm$^2$. In some embodiments, the Iyy is at least 255 kg*mm$^2$, at least 260 kg*mm$^2$, at least 265 kg*mm$^2$, at least 270 kg*mm$^2$, at least 275 kg*mm$^2$, at least 280 kg*mm$^2$, at least 285 kg*mm$^2$, or at least 290 kg*mm$^2$.

The golf club head 100 can comprise a CGy, as defined above, ranging from −5 to −7 mm. In some embodiments, the CGy can range from −5.0 to −5.5 mm, −5.5 to −6.0 mm, −6.0 to −6.5 mm, or −6.5 to −7 mm. In some embodiments, the CGy is at most −5 mm, at most −5.5 mm, at most −6.0 mm, at most −6.5 mm, or at most −6.9 mm.

The golf club head 100 can comprise a Ygp, as defined above, ranging from 9 to 12 mm. In some embodiments, the Ygp can range from 9.0 to 9.5 mm, 9.5 to 10.0 mm, 10.0 mm to 10.5 mm, 10.5 mm to 11.0 mm, 11.0 mm to 11.5 mm, or 11.5 mm to 12.0 mm. In some embodiments, the Ygp is at most 12.0 mm, at most 11.5 mm, at most 11.0 mm, at most 10.5 mm, at most 10.0 mm, or at most 9.5 mm.

2. Mass Pads

One way to move the discretionary mass gained from losing the excessive lap joint structure is by adding more strategically place mass pads to address Iyy and CGy. The golf club head 100 may comprise multiple mass pads located in different areas of the body 101 which improve the Iyy/CGy ratio. Specifically, the club head 100 can comprise a rear mass pad 124, a toe mass pad 128, a heel mass pad 138, and a sole mass pad 132. The rear mass pad 124 can extend from the rear heel end 121 to the rear end 111*a*. The toe mass pad 128 can be located at the toe end 106*a*. The heel mass pad 138 can be located at the heel end 104*a*. The sole mass pad 132 can be located on the sole 112. The rear mass pad 124, the toe mass pad 128, the heel mass pad, or a mass pad (not show) serves as a dual-purpose mass pad providing perimeter weighting and creating a portion of the lap joint.

Locating the mass pads around a perimeter of golf club head 100 increases the MOI, which equates to a more forgiving golf club. The placement of the mass pads further lowers the center of gravity 60, which increases the launch angle and spin, thereby advantageously increasing the stopping power of the golf club head. Thus, low and perimeter weighting provides better stopping power.

The rear mass pad 124 follows the curvature of the periphery of the golf club head 100, extending from the rear heel end 121 to the rear end 111*a*, with a smooth, planar rear mass pad top surface 125. The rear mass pad 124 is located below the horizontal midplane of the golf club head. The rear mass pad 124 may abut the rear end 111*a* and be formed integrally with a portion of the lap joint surface 141. The rear mass pad 124 serves as a dual-purpose mass pad and creates a portion of the lap joint surface 141. Stated another way, the rear mass pad 124 serves as a dual-purpose mass pad and may also be formed integrally with of the lap joint 140 and may provide a portion of the lap joint surface 141. Further, the rear mass pad 124 may abut the sole mass pad 132 and/or heel mass pad 138. Additionally, the rear mass pad 124 abuts the weight port 190, which is located in the rear end 111*a*. The location of the rear mass pad 124 helps move the center of gravity 60 down and towards the rear. Down and back weighting lowers the center of gravity 60 and increases the MOI. Further, the rear mass pad 124 being formed integrally with at least a portion of the lap joint 140 removes the need for additional pieces or tooling to provide surfaces to which the crown panel 150 can be joined.

The rear mass pad 124 comprises discretionary mass that shifts the center of gravity 60 to a favorable position and improves performance. The mass of the rear mass pad 124 may be between 5 grams and 20 grams. In some embodiments the rear mass pad 124 may have a mass between 5 grams and 6 grams, between 6 grams and 7 grams, between 7 grams and 8 grams, between 8 grams and 9 grams, between 9 grams and 10 grams, between 10 grams and 11 grams, between 11 grams and 12 grams, between 12 grams and 13 grams, between 13 grams and 14 grams, between 14 grams and 15 grams, between 15 grams and 16 grams, between 16 grams and 17 grams, between 17 grams and 18 grams, between 18 grams and 19 grams, or between 19 grams and 20 grams. Using a lighter or heavier mass in the rear mass pad 124 allows the CG and MOI to be fine-tuned.

Figure 6:
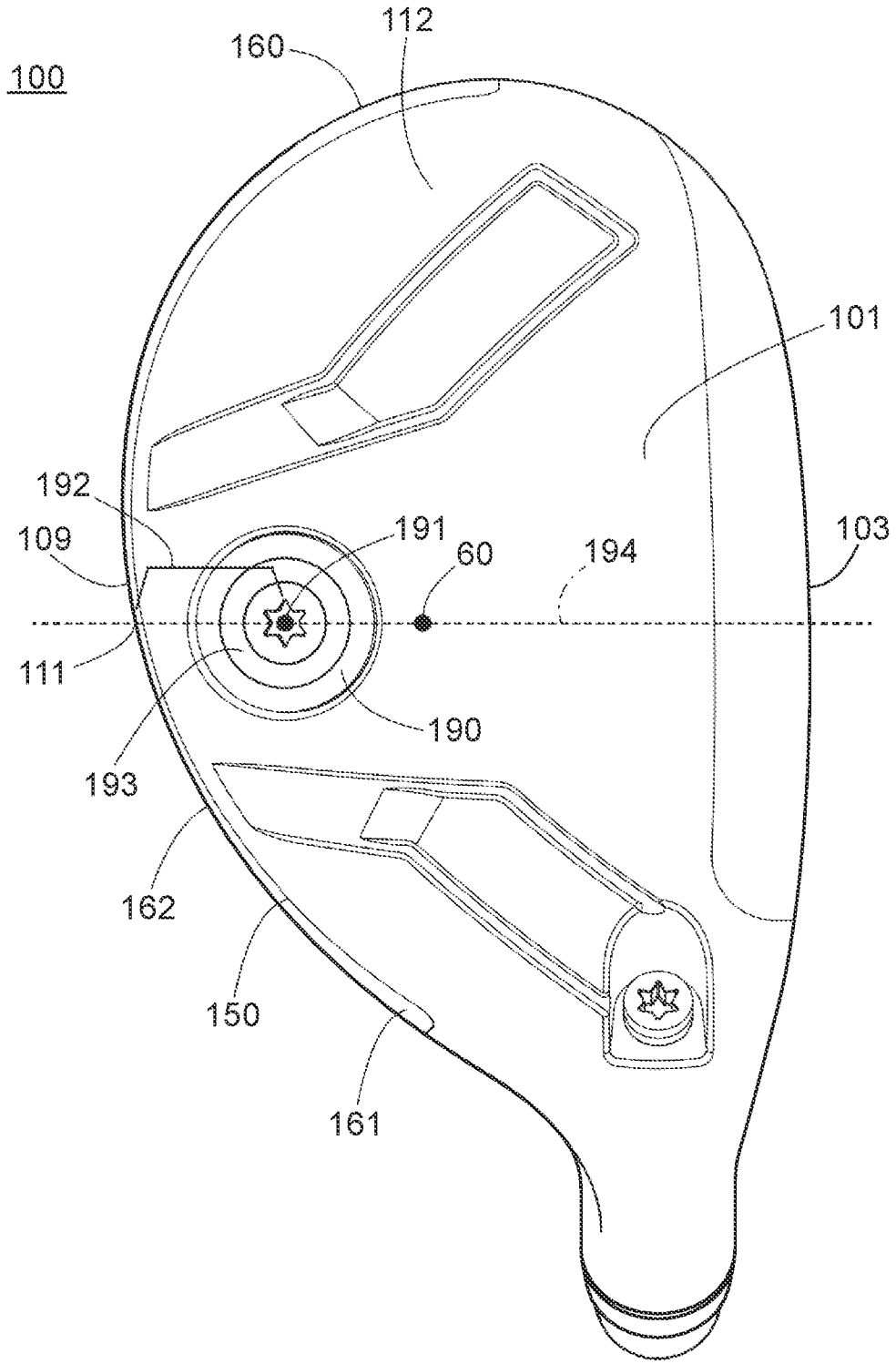
FIG. 6 illustrates a sole view of the golf club head of FIG. 1.

As illustrated in FIG. 6, the club head 100 may further comprise a weight port 190 positioned near the rear end 111*a* of the club head 100. FIG. 6 illustrates the crown panel 150 separating the weight port 190 and the rear skirt portion 162 of the crown panel 150. Further, a removable weight 193 can engage the weight port 190. In other embodiments, the removable weight 193 can be used in combination with mass pads 124, 128, and 132 to alter the center of gravity 60 to any desirable location, such as a low and rearward. Low and rearward weighting increases launch angle and spin rate, which improves the stopping power. Improved stopping power is better for more predictably stopping golf shots.

The removable weight 193 comprises a center of gravity 191, which may be spaced from a rear edge 111 of the club head 100 by a removable weight offset distance 192. The offset distance 192 is measured between the removable weight center of gravity 191 and the rear edge 111, along an axis 194 extending between the strike face 102 geometric center 116 and the removable weight center of gravity 191. The offset distance 192 may be between 0.1 inch and 1 inch. In some embodiments, the offset distance 192 may be between 0.1 inch and 0.2 inch, 0.2 inch and 0.3 inch, 0.3 inch and 0.4 inch, 0.4 inch and 0.5 inch, 0.5 inch and 0.6 inch, 0.6 inch and 0.7 inch, 0.7 inch and 0.8 inch, 0.8 inch and 0.9 inch, or between 0.9 inch and 1 inch.

The removable weight 193 can comprise a mass ranging from approximately 5 grams to 30 grams. For example, in some embodiments, the removable weight 193 can have a mass ranging from 5 to 10 grams, 10 to 15 grams, 15 to 20 grams, 20 to 25 grams, or 25 to 30 grams.

The toe mass pad 128 comprises a buildup of material formed integrally with the body in the toe end 106*a* of the golf club head 100. The toe mass pad 128 offsets the weight of the rear mass pad 124 and the heel mass pad 138, to achieve a desirably balanced golf club head. Further, the toe mass pad 128, heel mass pad 138, and the rear mass pad 124 combine to provide heel-toe weighting in the golf club, which improves Iyy. Increasing Iyy makes the golf club resist twisting on off-center strikes, thereby creating a more forgiving golf club.

Additionally, similar to the rear mass pad 124, the toe mass pad 128 serves as a dual-purpose mass pad and may also be formed integrally with of the lap joint 140 and may provide a portion of the lap joint surface 141.

As stated above, the toe mass pad 128 is located at the golf club head 100 toe end 106*a*. The toe mass pad may abut the sole mass pad 132 and/or the thinned portion 136. The thinned portion 136 can be located between the rear mass pad 124, the toe mass pad 128, and the sole mass pad 132. The thinned portion 136 is thinner than the rear mass pad 124, the toe mass pad 128, and the sole mass pad 132. The thinned portion 136 can be located in the toe to locate the CGx as close to the geometric center of the club head 100. The thinned region can be located proximate the lap joint and can abut a lap joint top surface between the rear mass pad 124 and the toe mass pad 128. The thinned portion 136 can comprise a thickness, measured as the perpendicular distance from the interior surface to the exterior surface of the club head, of less than about 0.040 inch. For example, the thinned portion 136 can be less than 0.039 inch, less than 0.038 inch, less than 0.037 inch, less than 0.036 inch, less than 0.035 inch, less than 0.034 inch, less than 0.033 inch, or less than 0.032 inch.

Further, the toe mass pad 128 creates a portion of the lap joint 140 and comprises a smooth, planar top surface 131. The lap joint 140, formed by the toe mass pad 128, smoothly transitions into the lap joint 140 abutting the thinned portion 136, which also smoothly transitions into the lap joint 140 formed by the rear mass pad 124. The smooth transition provides an even lap joint surface 141 for connecting the crown panel 150. The toe mass pad 128 is offset from the strike face 102 such that it will not interfere with the face flexing during a strike.

The toe mass pad 128 comprises discretionary mass that shifts the center of gravity 60 to a favorable position and improves performance. The mass of toe mass pad 128 may be between 2 grams and 15 grams. In some embodiments the toe mass pad 128 may have a mass between 2 grams and 3 grams, between 3 grams and 4 grams, between 4 grams and 5 grams, between 5 grams and 6 grams, between 6 grams and 7 grams, between 7 grams and 8 grams, between 8 grams and 9 grams, between 9 grams and 10 grams, between 10 grams and 11 grams, between 11 grams and 12 grams, between 12 grams and 13 grams, between 13 grams and 14 grams, or between 14 grams and 15 grams. Using a lighter or heavier mass in the toe mass pad 128 allows the CG and MOI to be fine-tuned.

The heel mass pad 138 comprises a build-up of material formed integrally with the body 101 in the heel end 104*a* of the golf club head 100. The heel mass pad 138 offsets the weight of the toe mass pad 128 and the rear mass pad 124, to achieve a desirably balanced golf club head. As stated above, the toe mass pad 128, heel mass pad 138, and the rear mass pad 124 combine to provide heel-toe weighting in the golf club, which increases forgiveness due to an improved Iyy.

The heel mass pad 138 is located in the heel end 104*a*, between the lap joint heel edge transition 147 and the hosel 105. The heel mass pad 138 may abut the sole mass pad 132 and/or the rear mass pad 124. Additionally, the heel mass pad 138 resides in the skirt 114 region and further makes up a portion of the lap joint 140, specifically in the lap joint heel edge transition 147 region.

The heel mass pad 138 comprises discretionary mass that shifts the center of gravity 60 to a favorable position and improves performance. The heel mass pad 138 can be the lightest of the mass pads since the rear mass pad 124 at least partially extends into the heel end 104*a*, and therefore heelward weighting is already present. The heelward weighting is used to offset the toeward weighting of the toe mass pad 128. The mass of the heel mass pad 138 may be between 0.5 grams and 5.0 grams. In some embodiments the heel mass pad 138 may have a mass between 0.5 grams and 1.0 grams, between 1.0 grams and 1.5 grams, between 1.5 grams and 2.0 grams, between 2.0 grams and 2.5 grams, between 2.5 grams and 3.0 grams, between 3.0 grams and 3.5 grams, between 3.5 grams and 4.0 grams, between 4.0 grams and 4.5 grams, or between 4.5 grams and 5.0 grams. Using a lighter or heavier mass in the heel mass pad 138 allows the CG and MOI to be fine-tuned.

The sole mass pad 132 comprises a buildup of material formed integrally with the body 101 in the sole 112 of the golf club head 100. The sole mass pad 132 may have a constant thickness or a variable thickness. Varying the thickness allows weight to be distributed to designed areas within the golf club head to achieve proper weighting and launch characteristics. The sole mass pad forms a portion of the interior surface 133 of the club head.

The sole mass pad 132 can comprise a variable thickness relative to the sole measured along the y-axis. The sole mass pad 132 may comprise a concave lens shape, wherein the center of the sole mass pad 132 is thinner relative to the heel-toe edges of the sole mass pad 132. Additionally, the sole mass pad 132 may be smoothly graduated from the sole mass pad 132 center to the sole mass pad 132 heel-toe edges. Further, the sole mass pad 132 may abut the rear mass pad 124, heel mass pad 138, toe mass pad 128, weight port 190, thinned portion 136, and/or the hosel 105. The sole mass pad 132 adds mass low on the golf club head to lower the center of gravity 60. Generally, the sole mass pad 132 will be rearward of the strike face rear surface 115 to allow the face to flex upon impact.

The sole mass pad 132 comprises discretionary mass that shifts the center of gravity 60 to a favorable position and improves performance. In some embodiments, the sole mass pad 132 is the heaviest of the mass pads to lower the center of gravity 60. The mass added by the sole mass pad 132 may be between 35 grams and 55 grams. In some embodiments, the sole pad 132 may have a mass between 35 grams and 37 grams, between 37 grams and 39 grams, between 39 grams and 41 grams, between 41 grams and 43 grams, between 43 grams and 45 grams, between 45 grams and 47 grams, between 47 grams and 49 grams, between 49 grams and 51 grams, between 51 grams and 53 grams, or between 53 grams and 55 grams. Using a lighter or heavier mass in the sole mass pad 132 allows the golf club head to be fine-tuned to be beneficial for different players' swings and skill levels.

The toe mass pad 128 is connected to the rear mass pad 124. These mass pads are connected via the lap joint rear edge top surface 149. The top surface of the toe mass pad and the top surface of the rear mass pad are co-planar, and define a periphery plane 169. Furthermore, the top surface of the toe mass pad and top surface of the rear mass pad can be co-planar with a top surface of the rear body lap joint, such that the rear mass pad top surface, toe mass pad top surface, and the lap joint rear edge top surface form one continuous, planar surface. In other words, the top surface of the toe and rear mass pads form a portion of the top of the lap joint.

Figure 19:
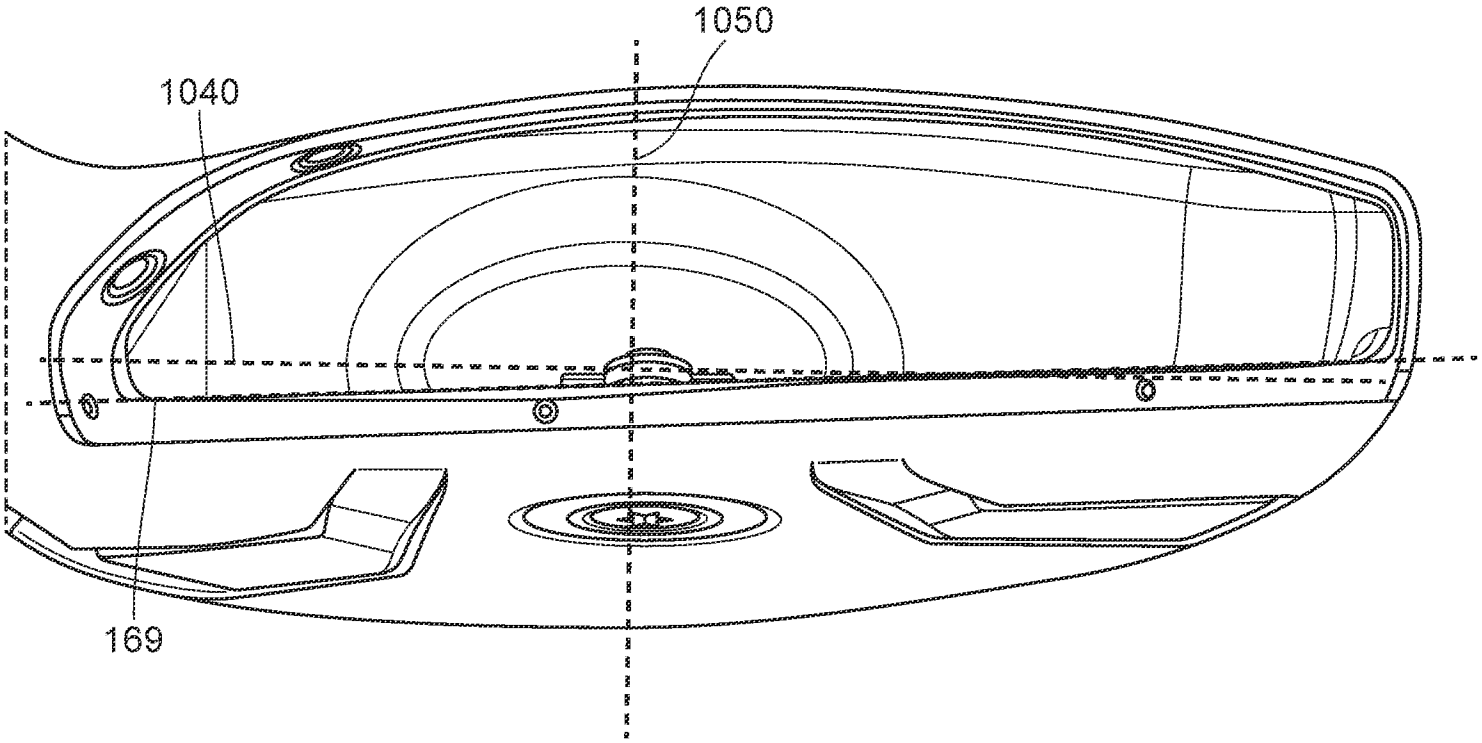
FIG. 19 illustrates a rear view of the golf club head of FIG. 1, without the crown panel.
Figure 20:
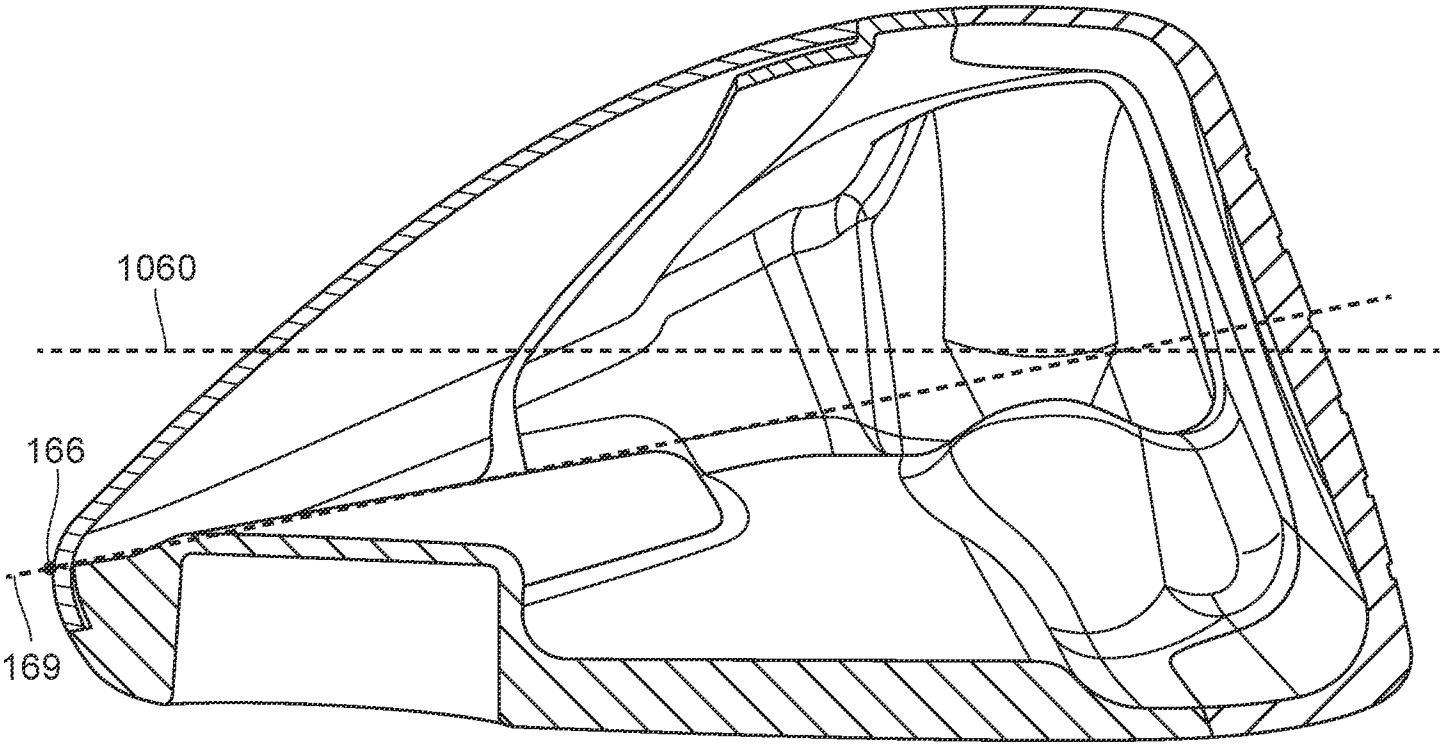
FIG. 20 illustrates a cross-sectional view of the golf club head of FIG. 1.

The periphery plane comprises a first angle, measured as the angle between the z-axis and the periphery plane 169, in a YZ plane, as illustrated in FIGS. 19 and 20. The periphery plane first angle provides improved draft angles that aid in removal of core pieces during tool creation. With the provided first angle, core pieces may be removed from the crown opening instead of the smaller face opening. Easier core removal reduces manufacturing time and costs. The first angle can range between 1 and 15 degrees. For example, the first angle can range between 1 and 3 degrees, 3 and 5 degrees, 5 and 7 degrees, 7 and 10 degrees, 8 and 11 degrees, 10 and 13 degrees, or 13 and 15 degrees. The first angle can be 1 degree, 2 degrees, 3 degrees, 4 degrees, 5 degrees, 6 degrees, 7 degrees, 8 degrees, 9 degrees, 10 degrees, 11 degrees, 12 degrees, 13 degrees, 14 degrees, or 15 degrees.

The periphery plane further comprises a second angle, measured as the angle between the x-axis and the periphery plane, in an XY plane, as illustrated in FIGS. 19 and 20. The second angle can range between −2 degrees and 5 degrees, where a negative degree results in a higher heel side and a positive degree result in a higher toe side. For example, the second angle can range from −2 to 0 degrees, 0 to 2 degrees, 1 to 3 degrees, 2 to 4 degrees, or 3 to 5 degrees. The second angle adjusts the heel-toe weighting of the club head.

The periphery plane further comprises an intersection point 166. The intersection point 166 is the point, in the YZ plane (midplane), where the periphery plane 169 intersects the rearward most point of the club head. In other embodiments, the intersection point 166 can intersect the skirt either heelward or toeward of the midplane.

Further to the various mass pads, a thinned portion 136 may be located to the rear of the golf club head. The thinned portion 136 is an area which does not comprise a mass pad and has a thin wall configuration. The thinned portion 136 allows mass to be redistributed to the heel and toe end to increase the Iyy of the golf club head, thereby improving the forgiveness. Additional heel and toe weighting resists twisting on off-center strikes, resulting in straighter flying golf shots. The heel and toe weighting assists in locating the CGx.

The location of the mass pads affects the performance of the club head. For instance, perimeter weighting increases the MOI, which equates to a more forgiving golf club. Further, low and perimeter weighting provides better stopping power. The low weighting lowers the center of gravity 60. The low weighting increases the launch angle by at least 0.5 degrees.

The perimeter weighting results in higher spin (as described below). The combination of a higher launch with more spin is beneficial to more predictably stopping golf shots.

3. Lap Joint

The golf club head further comprises a lap joint 140 along the perimeter of the body 101 and extending through the crown 110. The lap joint 140 further comprises a rear body lap joint section 155, a heel body lap joint section 156, a toe body lap joint section 157, and a crown body lap joint section 158. The lap joint may be located in regions such as the crown 110, skirt 114, sole 112, heel end 104*a*, and toe end 106*a*. The lap joint 140 is integrally formed with the body 101 and provide a surface to which a crown panel 150 (described in further detail below) is joined. The crown panel 150 may comprise a lightweight composite that encloses an opening 120 in the body 101.

The rear body lap joint section 155 can be disposed along a perimeter of the rear section from the heel end 104*a* to the toe end 106*a*. The heel body lap joint section 156 can extend upwardly from the rear body lap joint section 155 at the heel end 104*a*. Similarly, the toe body lap joint section 157 can extend from the rear body lap joint section 155 upwardly at the toe end 106*a*. The crown body lap joint section extends from the heel body lap joint section 156 to the toe body lap joint section 157. The lap joint sections may all be interconnected or, in some embodiments, discontinuous.

The rear body lap joint section 155 is formed at a periphery of the club head so that the rear mass pad 124, which forms a portion of the rear body lap joint edge 142, is placed in the furthermost periphery to increase the moment of inertia. The rear body lap joint section 155 is formed along the skirt 114, or perimeter, of the club head such that the rear body lap joint section 155 follows the general contour of the skirt 114.

The rear body lap joint section 155 can further define an upper edge, or rear body lap joint edge 142, disposed in the periphery plane 169. The rear body lap joint section 155 and the rear body lap joint edge 142 can be formed integrally with various components of the golf club head 100 such as the rear mass pad 124 or the toe mass pad 128. The mass pads forming a portion of the rear body lap joint edge 142 and remaining within the periphery plane 169 allows for the top surface of the mass pads to have a planar profile. Thereby simplifying fabrication, such as by reducing mold pieces required for casting.

Figure 17:
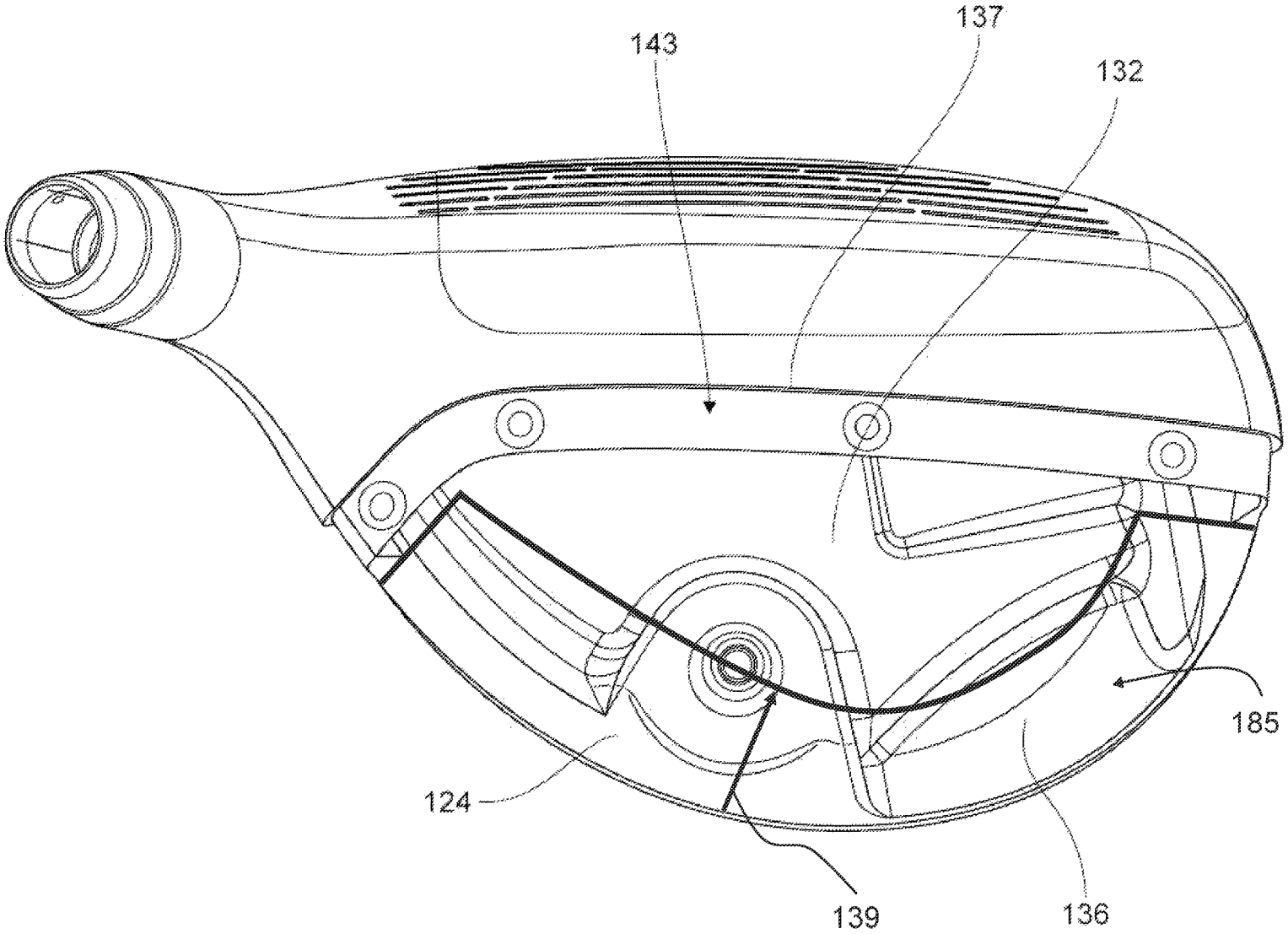
FIG. 17 illustrates a top view of the golf club head of FIG. 1, without the crown panel.
Figure 18:
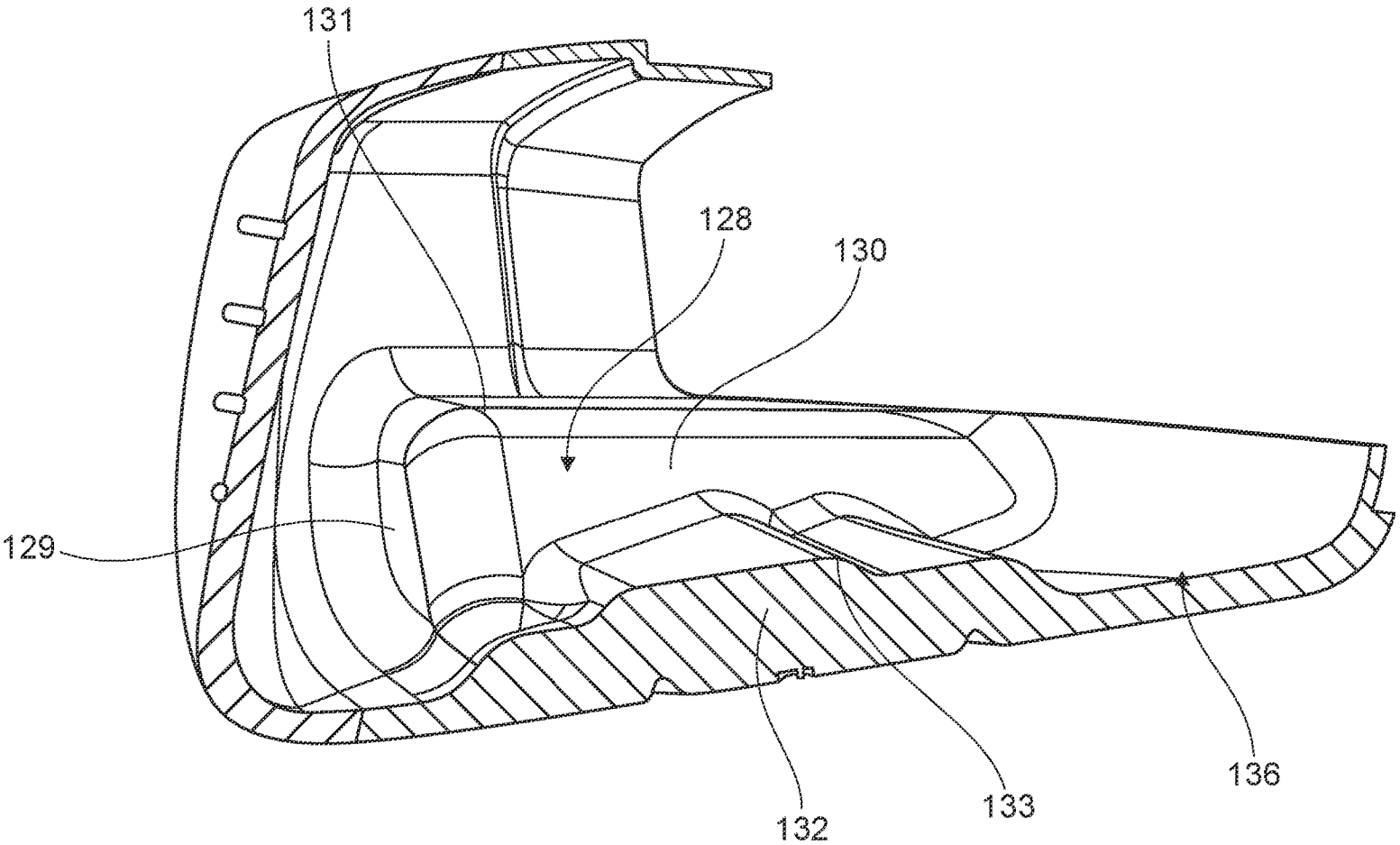
FIG. 18 illustrates a cross-sectional view of the golf club head of FIG. 1.

Further some embodiments may comprise a mass pad peripheral distance 139 as shown in FIG. 17. The mass pad peripheral distance 139 can be defined as a distance measured perpendicular to any point along the rear body lap joint edge 142. This creates a mass pad peripheral zone 185 that follows the contour of the rear of the golf club head 100. This distance sets a boundary for how the rear mass pad 124 and the toe mass pad 128, or any mass pad abutting the lap joint extends from the rear body lap joint edge 142. This boundary only applies to the portion of the mass pad that is extending inward perpendicular to the rear body lap joint edge 142. In other words, there can be portions of a lap joint abutting mass pad that do not abut the mass pad. The portions that abut the mass pad are restricted by the mass pad peripheral distance 139. In some embodiments, the mass pad peripheral distance 139 can be between 0.35 inch and 0.47 inch. In other embodiments the mass pad peripheral distance 139 may be between 0.35 inch and 0.38 inch, between 0.38 and 0.41 inch, between 0.41 inch and 0.44 inch, or between 0.44 inch and 0.47 inch. In other words, a mass pad comprising a portion abutting the lap joint cannot extend more than 0.42 inch towards the interior cavity. The mass pad peripheral zone 185 comprises between 10 grams and 30 grams of mass pad mass. In some embodiments, the mass pad peripheral zone 185 comprises between 10 grams and 15 grams, between 15 grams and 20 grams, between 20 grams and 25 grams, or between 25 grams and 30 grams. Retaining the portion of the mass pad that abuts the lap joint within the mass pad peripheral distance 139 retains the discretionary weight placed by the mass pad to the outer periphery of the golf club head 100.

The rear body lap joint edge 142 generally spans the rear or the body 101 from the heel end 104*a* to the toe end 106*a* to provide a surface to which the crown panel 150 is joined. The rear body lap joint edge 142 can have an arc length between 3.5 inches and 4.5 inches.

The rear mass pad 124 can form a portion of the rear body lap joint edge 142 to achieve a lower center of gravity 60 and to simplify the fabrication and assembly of the golf club. In some embodiments the rear mass pad 124 can form between 0.5 inch to 2.5 inches of the rear body lap joint edge 142.

The rear mass pad 124 may form a significant portion of the rear body lap joint edge 14, thereby placing mass at the periphery of the club head 100. The rear mass pad 124 can form between 10% and 75% of the rear body lap joint edge 142.

The quantity of perimeter weighting provided by the rear mass pad 124 can be characterized by a ratio of a mass of the rear mass pad 124 to a length the rear mass pad 124 that forms a portion of the rear body lap joint edge 142. For example, the mass-length ratio can be between 0.1 and 10. As the ratio between the rear mass pad 124 to the length the rear mass pad 124 forms of the rear body lap joint edge 142 approaches 0.1, more mass is distributed along the rear body lap joint edge 142. In turn, more mass is distributed to the periphery of the club head 100 improving MOI.

The toe mass pad 128 can form a portion of the rear body lap joint edge 142, thereby placing additional mass along the periphery of the club head 100. In some embodiments, the toe mass pad 128 can form between 0.25 inch to 2.0 inches of the rear body lap joint edge 142.

Alternatively, the quantity of the perimeter weighting provided by the rear mass pad 124 can be characterized by a percentage of area of the rear body lap joint edge 142 it provides. Fore example, the toe mass pad 128 can form between 5% and 60% of the rear body lap joint edge 142.

A ratio between the toe mass pad 128 mass to the length the toe mass pad 128 forms of the rear body lap joint edge 142 can be between 0.1 and 20. In a preferred embodiment the ratio is approximately 16.65. As the ratio between the toe mass pad 128 to the length the toe mass pad 128 forms of the rear body lap joint edge 142 approaches 0.1, more mass is distributed along the rear body lap joint edge 142. In turn, more mass is distributed to the periphery of the club head 100 improving MOI.

The thinned portion 136 can form a portion of the rear body lap joint edge 142. The thinned portion 136 can form between 1.0 inch and 2.0 inches of the rear body lap joint edge 142. As discussed above the thinned portion 136 provides discretionary mass to put into the rear mass pad and toe mass pad to fine tune the club head CG and MOI properties.

The thinned portion 136 is a region at the periphery of the golf club head 100 that allows for more heel-toe weighting and abuts a portion of the lap joint 140. The thinned portion can form between 30 and 40% of the rear body lap joint edge 142.

The golf club head 100 comprises various mass pads that may partially form the lap joint 140. Any mass pad including the rear mass pad 124 and the toe mass pad 128 can form between 60 and 70% of the rear body lap joint edge 142.

The rear mass pad top surface 125, the toe mass pad top surface 131, and the lap joint rear edge top surface 149 all form one surface. The surface formed by all three top surfaces, 125, 131, and 149 can comprise a total surface area between 0.3 $inch^2$ and 0.7 $inch^2$. The rear mass pad top surface 125 surface area can be between 0.2 $inch^2$ and 0.45 $inch^2$. The toe mass pad top surface 131 surface area can be between 0.05 inch$^2$ and 0.2 inch$^2$. The lap joint rear edge top surface 149 surface area can be between 0.01 inch$^2$ and 0.04 inch$^2$.

The rear mass pad 124, toe mass pad 128, and the rear body lap joint edge 142 comprise a top surface that contributes a percentage of the total lap joint top surface area. The rear mass pad top surface 125 surface area can form between 20% and 90% of the total surface area. The toe mass pad top surface area can form between 5% and 60% of the total surface area. The lap joint rear edge top surface 149 surface area can form between 0.5% and 15% of the total surface area.

The lap joint 140 comprises a lap joint surface 141 that may be continuous or discontinuous around the club head and provides a surface to which the a crown panel 150 is joined. The lap joint surface 141 has a width that may be constant or vary around the golf club head 100. The lap joint surface 141 width may be between 0.050 inches and 0.300 inches. In some embodiments, the lap joint surface 141 width may be between 0.050 inches and 0.075 inches, between 0.075 inches and 0.100 inches, between 0.100 inches and 0.125 inches, between 0.125 inches and 0.150 inches, between 0.150 inches and 0.175 inches, between 0.175 inches and 0.200 inches, between 0.200 inches and 0.225 inches, between 0.225 inches and 0.250 inches, between 0.250 inches and 0.275 inches, or between 0.275 inches and 0.300 inches.

A rear lap joint surface area can be defined as the lap joint surface 141 surface area along the rear body lap joint edge 142 and bounded by an imaginary line extending from the lap joint heel edge 143 and an imaginary line extending from the lap joint toe edge 145. In other words, the rear lap joint surface area is the portion of the lap joint along the skirt excluding the portions past the lap joint heel edge 143 and the lap joint toe edge 145. The rear lap joint surface area can be between 0.35 inch$^2$ and 0.65 inch$^2$. The rear mass pad 124 can comprise a portion of the rear lap joint surface area. The rear mass pad 124 surface area comprising the rear lap joint surface area can be between 0.15 inch$^2$ and 0.35 inch$^2$. The toe mass pad 128 can comprise a portion of the rear lap joint surface area. The toe mass pad 128 surface area comprising the rear lap joint surface area can be between 0.05 inch$^2$ and 0.2 inch$^2$. The thinned portion 136 can comprise a portion of the rear lap joint surface area. The thinned portion 136 comprising the rear lap joint surface area comprising the rear lap joint surface area can be between 0.1 inch$^2$ and 0.2 inch$^2$.

The various mass pads and thinned region form the a percentage of the rear lap joint surface area. The rear mass pad 124 surface area can form between 15% and 80% of the rear lap joint surface area. The toe mass pad 128 surface area can form between 5% and 60% of the rear lap joint surface area. The thinned portion 136 surface area can form between 1% and 20% of the rear lap joint surface area.

The lap joint 140 may be located on the crown 110, the skirt 114, and/or the sole 112, wherein the crown panel 150 may wrap from the crown 110 into either the skirt 114, the sole 112, or both the skirt 114 and sole 112. Additionally, the lap joint 140 further comprises a lap joint edge 144. The lap joint edge 144 can be partially around or entirely around the lap joint 140. The lap joint edge 144 is the edge proximate the opening 120. The lap joint edge 144 further comprises a lap joint heel edge 143, a rear body lap joint edge 142, a lap joint toe edge 145, and a lap joint crown edge 146. The lap joint heel edge 143 and the lap joint toe edge 145 may further be divided into a lap joint heel edge transition 147 and a lap joint toe edge transition 148, respectively. The lap joint heel edge transition 147 and the lap joint toe edge transition 148 define where the lap joint edge 144 sharply changes direction towards the lap joint crown edge 146. The lap joint heel edge transition 147 and the lap joint toe edge transition 148 may comprise the lap joint edge 144 making between a 45 degree and 105 degree change. In some embodiments the lap joint edge 144 may change by between 45 degrees and 55 degrees, between 55 degrees and 65 degree, between 65 degrees and 75 degrees, between 75 degrees and 85 degrees, between 85 degrees and 95 degrees, or between 95 degrees and 105 degrees.

The lap joint edge 144 rearward of the lap joint heel edge transition 147 and the lap joint toe edge transitions 148 further forms a plane. This plane relative to the ground plane 1010 may be at an angle, due to the incline and curvature of the lap joint edge 144. For instance, the plane may be tilted in the heel-toe direction, wherein the lap joint toe edge 145 is higher than the lap joint heel edge 143. Relative to the ground plane 1010, the heel-toe incline may be between 0 degrees and 25 degrees. In other embodiments, the heel-toe incline may be between 0 degrees and 5 degrees, between 5 degrees and 10 degrees, between 10 degrees and 15 degrees, between 15 degrees and 20 degrees, or between 20 degrees and 25 degrees. The plane may also be tilted in the front to rear direction, wherein the lap joint heel edge 143 and the lap joint toe edge 145 is higher than the rear body lap joint edge 142. Relative to the ground plane 1010, the front-rear incline may be between 0 degrees and 25 degrees. In other embodiments, the front-rear incline may be between 0 degrees and 5 degrees, between 5 degrees and 10 degrees, between 10 degrees and 15 degrees, between 15 degrees and 20 degrees, or between 20 degrees and 25 degrees.

The lap joint 140 construction provides an easier method of manufacturing. Previous designs have utilized structures such as undercuts and support pieces for attaching a composite to a golf club. The lap joint 140 being integral with the low and peripheral rear mass pad 124 and toe mass pad 128 simplifies the fabrication and assembly of the golf club by providing an easily accessible surface to adhere a crown panel 150. The lap joint 140 is formed in the casting of the body 101, removing any complicated tooling steps. Undercuts and additional pieces require more complex tooling and can further make the attachment of a crown panel 150 more difficult. Having a lap joint 140 integrally formed with the low and peripheral mass pad 124 and toe mass pad 128 also aids in the finishing step of manufacturing, as adhering and polishing the crown panel 150 at the connection joint in the skirt 114 allows the worker to simply follow the contour of the rear end 111*a* when finishing the club.

The rear body lap joint edge 142 arc length can be between 3.5 and 3.75 inches, between 3.75 and 4.0 inches, between 4.0 and 4.25 inches, or between 4.25 and 4.5 inches. The rear body lap joint edge 142 arc length can be greater than 3.5 inches, greater than 3.75 inches, greater than 4.0 inches, greater than 4.25 inches, or greater than 4.5 inches. The rear body lap joint edge 142 arc length can be less than 4.5 inches, less than 4.25 inches, less than 4.0 inches, less than 3.75 inches, or less than 3.5 inches. The rear body lap joint edge can be between 4.01 inch and 4.03 inch, between 4.03 inch and 4.05 inch, 4.05 inch and 4.07 inch, between 4.07 inch and 4.09 inch, or between 4.09 inch and 4.011 inch.

The rear mass pad 124 can form between 0.5 inch to 1 inch of the rear body lap joint edge 142. The rear mass pad 124 can form between 1 inch to 1.5 inches of the rear body lap joint edge 142. The rear mass pad 124 can form between 1.5 inches to 2.0 inches of the rear body lap joint edge 142. The rear mass pad 124 can form between 2.0 inches to 2.5 inches of the rear body lap joint edge 142. The rear mass pad 124 can form greater than 0.5 inch of the rear body lap joint edge 142. The rear mass pad 124 can form greater than 1 inch of the rear body lap joint edge 142. The rear mass pad 124 can form greater than 1.5 inches of the rear body lap joint edge 142. The rear mass pad 124 can form greater than 2.0 inches of the rear body lap joint edge 142. The rear mass pad 124 can form greater than 2.5 inches of the rear body lap joint edge 142. The rear mass pad 124 can form less than 2.5 inches of the rear body lap joint edge 142. The rear mass pad 124 can form less than 2.0 inches of the rear body lap joint edge 142. The rear mass pad 124 can form less than 1.5 inches of the rear body lap joint edge 142. The rear mass pad 124 can form less than 1 inch of the rear body lap joint edge 142. The rear mass pad 124 can form less than 0.5 inch of the rear body lap joint edge 142.

The rear mass pad can form between 10% and 15% of the rear body lap joint edge. The rear mass pad can form between 15% and 20% of the rear body lap joint edge. The rear mass pad can form between 20% and 25% of the rear body lap joint edge. The rear mass pad can form between 25% and 30% of the rear body lap joint edge. The rear mass pad can form between 30% and 35% of the rear body lap joint edge. The rear mass pad can form between 35% and 40% of the rear body lap joint edge. The rear mass pad can form between 40% and 45% of the rear body lap joint edge. The rear mass pad can form between 45% and 50% of the rear body lap joint edge. The rear mass pad can form between 50% and 55% of the rear body lap joint edge. The rear mass pad can form between 55% and 60% of the rear body lap joint edge. The rear mass pad can form between 60% and 65% of the rear body lap joint edge. The rear mass pad can form between 65% and 70% of the rear body lap joint edge. The rear mass pad can form between 70% and 75% of the rear body lap joint edge. The rear mass pad can form less than 75%. The rear mass pad can form less than 70% of the rear body lap joint edge 142. The rear mass pad can form less than 65% of the rear body lap joint edge 142. The rear mass pad can form less than 60% of the rear body lap joint edge 142. The rear mass pad can form less than 55% of the rear body lap joint edge 142. The rear mass pad can form less than 50% of the rear body lap joint edge 142. The rear mass pad can form less than 45% of the rear body lap joint edge 142. The rear mass pad can form less than 40% of the rear body lap joint edge 142. The rear mass pad can form less than 35% of the rear body lap joint edge 142. The rear mass pad can form less than 30% of the rear body lap joint edge 142. The rear mass pad can form less than 25% of the rear body lap joint edge 142. The rear mass pad can form less than 20% of the rear body lap joint edge 142. The rear mass pad can form less than 15% of the rear body lap joint edge 142. The rear mass pad can form less than 10% of the rear body lap joint edge 142.

The ratio between the rear mass pad 124 mass to the length the rear mass pad 124 forms of the rear body lap joint edge 142 can be between 0.1 and 1.0. The ratio between the rear mass pad 124 mass to the length the rear mass pad 124 forms of the rear body lap joint edge 142 can be between 1.0 and 2.0, between 2.0 and 3.0, between 3.0 and 4.0, between 4.0 and 5.0, between 5.0 and 6.0, between 6.0 and 7.0, between 7.0 and 8.0, between 8.0 and 9.0, or between 9.0 and 10.0. The ratio between the rear mass pad 124 mass to the length the rear mass pad 124 forms of the rear body lap joint edge 142 can be larger than 0.1, larger than 1.0, larger than 2.0, larger than 3.0, larger than 4.0, larger than 5.0, larger than 6.0, larger than 7.0, larger than 8.0, larger than 9.0, or larger 10.0. The ratio between the rear mass pad 124 mass to the length the rear mass pad 124 forms of the rear body lap joint edge 142 can be less than 0.1, less than 1.0, less than 2.0, less than 3.0, less than 4.0, less than 5.0, less than 6.0, less than 7.0, less than 8.0, less than 9.0, or less 10.0. Further, the ratio between the rear mass pad 124 mass to the length the rear mass pad 124 forms of the rear body lap joint edge 142 can be between 5.0 and 6.0. The ratio between the rear mass pad 124 mass to the length the rear mass pad 124 forms of the rear body lap joint edge 142 can be between 5.0 and 5.2, between 5.2 and 5.4, between 5.4 and 5.6, between 5.6 and 5.8, or between 5.8 and 6.0.

The toe mass pad 128 can form between 0.25 inch to 0.50 inch, between 0.50 inch and 0.75 inch, between 0.75 inch and 1.00 inch, between 1.00 inch and 1.25 inches, between 1.25 inches and 1.50 inches, between 1.50 inches and 1.75 inches, or between 1.75 inches and 2.00 inches of the rear body lap joint edge 142. The toe mass pad 128 greater than 0.25 inch, greater than 0.50 inch, greater than 0.75 inch, greater than 1.00 inch, greater than 1.25 inches, greater than 1.50 inches, greater than 1.75 inches, or greater than 2.00 inches of the rear body lap joint edge 142. The toe mass pad 128 less than 0.25 inch, less than 0.50 inch, less than 0.75 inch, less than 1.00 inch, less than 1.25 inches, less than 1.50 inches, less than 1.75 inches, or less than 2.00 inches of the rear body lap joint edge 142.

Further, the toe mass pad 128 can form between 5% and 10%, between 10% and 15%, between 15% and 20%, between 20% and 25%, between 25% and 30%, between 30% and 35%, between 35% and 40%, between 40% and 45%, between 45% and 50%, between 50% and 55%, or between 55% and 60% of the rear body lap joint edge 142. The toe mass pad 128 can form greater than 5%, greater than 10%, greater than 15%, greater than 20%, greater than 25%, greater than 30%, greater than 35%, greater than 40%, greater than 45%, greater than 50%, greater than 55%, or greater than 60% of the rear body lap joint edge 142. The toe mass pad 128 can form less than 5%, less than 10%, less than 15%, less than 20%, less than 25%, less than 30%, less than 35%, less than 40%, less than 45%, less than 50%, less than 55%, or less than 60% of the rear body lap joint edge 142.

Further, a ratio between the toe mass pad 128 mass to the length the toe mass pad 128 forms of the rear body lap joint edge 142 can be between 0.1 and 2.0, between 2.0 and 4.0, between 4.0 and 6.0, between 6.0 and 8.0, between 8.0 and 10.0, between 10.0 and 12.0, between 12.0 and 14.0, between 14.0 and 16.0, between 16.0 and 18.0, or between 18.0 and 20.0. The ratio between the toe mass pad 128 mass to the length the toe mass pad 128 forms of the rear body lap joint edge 142 can be larger than 0.1, larger than 1.0, larger than 2.0, larger than 3.0, larger than 4.0, larger than 5.0, larger than 6.0, larger than 7.0, larger than 8.0, larger than 9.0, larger than 10.0, larger than 11.0, larger than 12.0, larger than 13.0, larger than 14.0, larger than 15.0, larger than 16.0, larger than 17.0, larger than 18.0, larger than 19.0, or larger 20.0. The ratio between the toe mass pad 128 mass to the length the toe mass pad 128 forms of the rear body lap joint edge 142 can be less than 0.1, less than 1.0, less than 2.0, less than 3.0, less than 4.0, less than 5.0, less than 6.0, less than 7.0, less than 8.0, less than 9.0, less than 10.0, less than 11.0, less than 12.0, less than 13.0, less than 14.0, less than 15.0, less than 16.0, less than 17.0, less than 18.0, less than 19.0, or less 20.0. Further, the ratio between the toe mass pad 128 mass to the length the toe mass pad 128 forms of the rear body lap joint edge 142 can be between 16.0 and 17.0. The ratio between the toe mass pad 128 mass to the length the toe mass pad 128 forms of the rear body lap joint edge 142 can be between 16.0 and 16.2, between 16.2 and 16.4, between 16.4 and 16.6, between 16.6 and 16.8, or between 16.8 and 17.0.

The thinned portion 136 edge can form between 1.0 inch and 2.0 inches of the rear body lap joint edge. The thinned portion 136 edge can form between 1.0 inch and 1.2 inches, 1.2 inches and 1.4 inches, 1.4 inches and 1.6 inches, 1.6 inches and 1.8 inches, or between 1.8 inches and 2.0 inches of the rear body lap joint edge 142.

The thinned portion 136 edge can form between 30% and 40% of the rear body lap joint edge 142. The thinned portion 136 edge can form between 30% and 33%, 33% and 36%, or between 36% and 40% of the rear body lap joint edge 142.

Any mass pad including the rear mass pad 124 and the toe mass pad 128 can form alternative ranges and percentages of the rear body lap joint edge 142. For example, any mass pad can form between 60 and 65%, or between 65% and 70% of the rear body lap joint edge 142.

The surface formed by all three top surfaces, 125, 131, and 147 can comprise a total surface area between 0.3 $inch^2$ and 0.7 $inch^2$. For example, the total surface area formed by all three top surfaces 125, 131, and 149 may be between 0.3 $inch^2$ and 0.4 $inch^2$, between 0.4 $inch^2$ and 0.5 $inch^2$, between 0.5 $inch^2$ and 0.6 $inch^2$, or between 0.6 $inch^2$ and 0.7 $inch^2$.

The rear mass pad top surface 125 surface area can be between 0.2 $inch^2$ and 0.45 $inch^2$. For example, the rear mass pad top surface 125 surface area can be between 0.2 $inch^2$ and 0.25 $inch^2$, between 0.25 $inch^2$ and 0.30 $inch^2$, between 0.30 $inch^2$ and 0.35 $inch^2$, between 0.35 $inch^2$ and 0.40 $inch^2$, or between 0.40 $inch^2$ and 0.45 $inch^2$.

The toe mass pad top surface 131 surface area can be between 0.05 $inch^2$ and 0.2 $inch^2$. For example, the toe mass pad top surface 131 surface area can be between 0.05 $inch^2$ and 0.10 $inch^2$, between 0.10 $inch^2$ and 0.15 $inch^2$, or between 0.15 $inch^2$ and 0.20 $inch^2$.

The lap joint rear edge top surface 149 surface area can be between 0.010 $inch^2$ and 0.015 $inch^2$, between 0.015 $inch^2$ and 0.020 $inch^2$, between 0.020 $inch^2$ and 0.025 $inch^2$, between 0.025 $inch^2$ and 0.030 $inch^2$, between 0.030 $inch^2$ and 0.035 $inch^2$, or between 0.035 $inch^2$ and 0.040 $inch^2$.

The rear mass pad top surface 125 surface area can comprise alternative ranges and percentages of the total surface area. The rear mass pad top surface area can form between 20% and 25%, 25% and 30%, 30% and 35%, 35% and 40%, 40% and 45%, 45% and 50%, 50% and 55%, 55% and 60%, 60% and 65%, 65% and 70%, 70% and 75%, or 75% to 80%.

The toe mass pad top surface area can comprise alternative ranges and percentages of the total surface area. The toe mass pad top surface area can form between 5% and 10%, 10% and 15%, 15% and 20%, 20% and 25%, 25% and 30%, 30% and 35%, 35% and 40%, 40% and 45%, 45% and 50%, 50% and 55%, or 55% and 60%.

The lap joint rear edge top surface 149 surface area can form between 0.5% and 15% of the total surface area. The lap joint rear edge top surface 149 surface area can form between 0.5% and 2.0%, between 2.0% and 3.5%, between 3.5% and 5.0%, between 5.0% and 6.5%, between 6.5% and 8%, between 8% and 9.5%, between 9.5% and 11%, between 11% and 12.5%, between 12.5% and 14%, or between 14% and 15%.

The rear lap joint surface area can be between 0.35 $inch^2$ and 0.40 $inch^2$, 0.40 $inch^2$ and 0.45 $inch^2$, 0.45 $inch^2$ and 0.50 $inch^2$, 0.50 $inch^2$ and 0.55 $inch^2$, 0.55 $inch^2$ and 0.60 $inch^2$, or 0.60 $inch^2$ and 0.65 $inch^2$.

The rear mass pad 124 can form between 0.15 $inch^2$ and 0.20 $inch^2$, 0.20 $inch^2$ to 0.25 $inch^2$, 0.25 $inch^2$ and 0.30 $inch^2$, or between 0.30 $inch^2$ and 0.35 $inch^2$ of the rear lap joint surface area.

The toe mass pad 128 can form between 0.05 $inch^2$ and 0.20 $inch^2$ of the rear lap joint surface area. The toe mass pad 128 can form between 0.05 $inch^2$ and 0.10 $inch^2$, between 0.10 $inch^2$ and 0.15 $inch^2$, or between 0.15 $inch^2$ and 0.20 $inch^2$ of the rear lap joint surface area.

The thinned portion 136 can form between 0.1 $inch^2$ and 0.2 $inch^2$ of the rear lap joint surface area. The thinned portion 136 can form between 0.1 $inch^2$ and 0.15 $inch^2$ or between 0.15 $inch^2$ and 0.20 $inch^2$ of the rear lap joint surface area.

The rear mass pad 124 surface area can form between 15% and 25%, 25% and 35%, 35% and 45%, 45% and 55%, 55% and 65%, 65% and 75%, or between 75% and 80% of the rear lap joint surface area.

The toe mass pad 128 surface area can form between 5% and 15%, 15% and 20%, 20% and 25%, 25% and 30%, 30% and 35%, 35% and 40%, 40% and 45%, 45% and 50%, 50% and 55%, or between 55% and 60% of the rear lap joint surface area.

The thinned portion 136 surface can form between 1% and 5%, 5% and 10%, 10% and 15%, or between 15% and 20% of the rear lap joint surface area.

II. Crown Panel

The crown panel 150 can be formed of a lightweight material that increases discretionary weight of the golf club head. The crown panel 150 comprises a portion of the crown, the skirt and/or the sole. In some embodiments, the crown panel 150 comprises a portion of the crown and a portion of the skirt. In other embodiments the crown panel 150 comprises portions of the crown 110, skirt 114, and sole 112. Extending the crown panel 150 from the crown 110 into the skirt and/or the sole, increases discretionary mass that can be used to alter the center of gravity 60 of the club head. The crown panel 150 wrapping around the skirt further improves aesthetics of the club head by placing the split line, where the crown insert transitions to the metal body, below the crown so that it cannot be seen at an address position. The crown panel 150, in combination with a removable weight 193, permits more advantageous placement of the center of gravity 60.

The crown panel 150 further comprises a skirt heel portion 161, a skirt toe portion 160, and a rear skirt portion 162. The skirt toe portion 160 and the skirt heel portion 161 can overlap the rear skirt portion 162 when viewing the club head 100 from the sole 112. The crown panel 150 of the club head 100 continuously forms a portion of the skirt 114. In these embodiments, the rear skirt portion 162 of the crown panel 150 can reduce the weight of the club head 100, providing more discretionary weight to be placed below the horizontal mid-plane, such as the rear mass pad 124, toe mass pad 128, and sole mass pad 132. More weight below the horizontal mid-plane helps lower the center of gravity 60.

The rear skirt portion 162 of the crown panel 150 increases the percentage of composite material in the skirt 114. The wrap design of the crown panel 150 provides more composite material, removes mass from the crown 110 and skirt 114, and allows for more discretionary mass to shift the center of gravity 60 down and back (relative to embodiments where the crown panel 150 does not extend into the rear skirt portion 162). The club head 100 configuration may increase spin rate relative to a club head devoid of a crown panel 150 including a rear skirt portion 162. Increasing spin rate may be desirable for producing a hybrid or fairway wood with better stopping power. To achieve these desirable club head characteristics, the crown panel 150 can comprise a large percentage of the crown 110 surface area and sole 112 surface area.

The sole 112 can be defined as a portion of the club head 100 that is tangent to the ground plane 1010 at the address position. A skirt 114 of the club head 100 can be defined as a junction between the sole 112 and the crown 110, forming a perimeter of the club head 100 behind the striking face 102. Stated another way, the skirt 4130 can be a portion of the club head 100 that transitions from the crown 110 to the sole 112.

The amount of discretionary weight added by the crown panel 150 can be characterized by the amount of surface area of the crown 110 that is provided by the crown panel 150. Specifically, the crown panel 150 can comprise between 65% and 85% of the crown 110 surface area. In some embodiments, the crown panel 150 may comprise between 65% and 70%, 70% and 75%, 75% and 80%, or 80% and 85% of the crown 110 surface area. Further, the crown panel 150 may comprise between 50% and 95% of the skirt 114 surface area. In some embodiments, the crown panel 150 can comprise between 50% and 55%, 55% and 60%, 60% and 65%, 65% and 70%, 70% and 75%, 75% and 80%, 80% and 85%, 85% and 90%, or 90% and 95% of the skirt 114 surface area.

Figure 7:
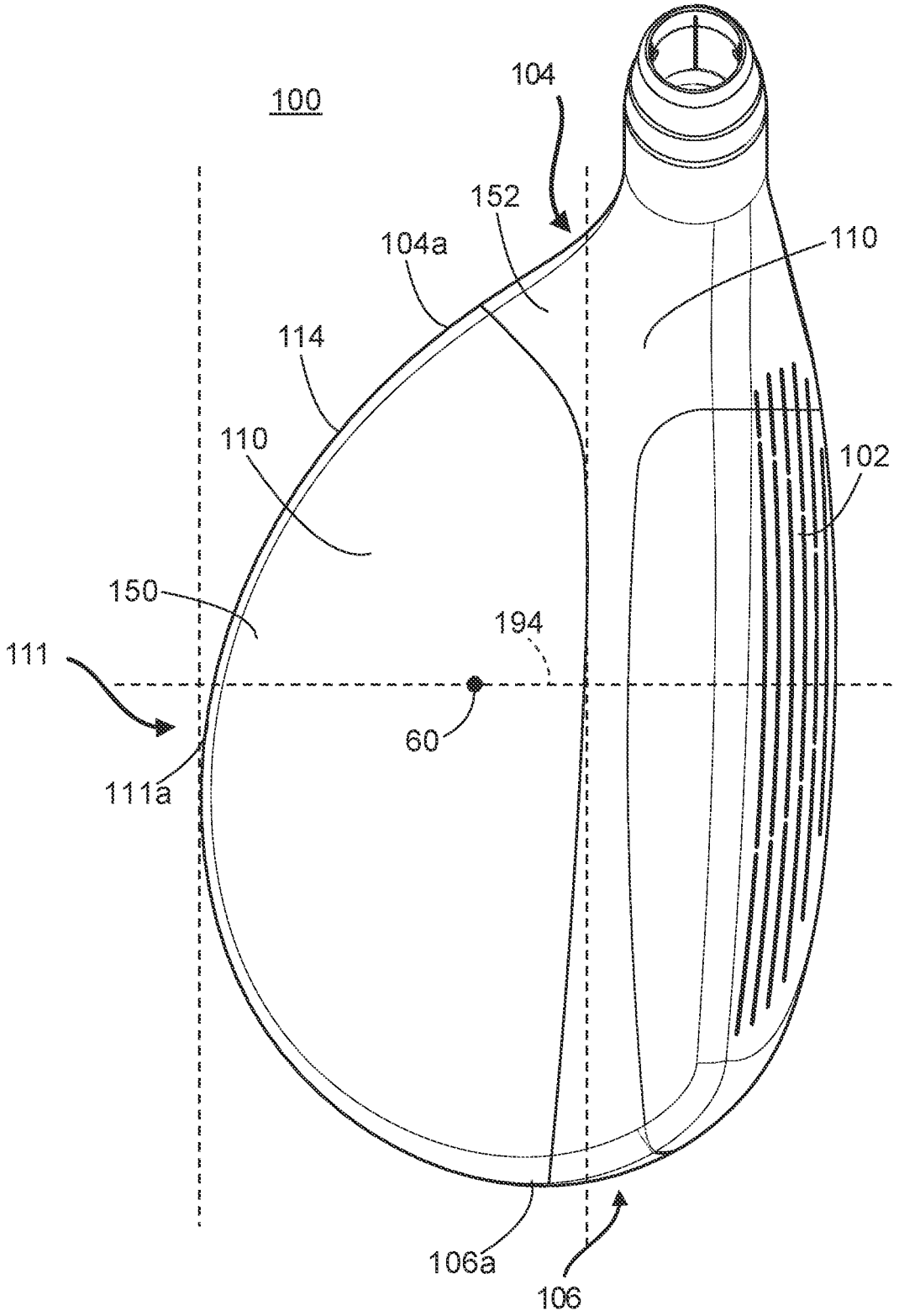
FIG. 7 illustrates a top view of the golf club head of FIG. 1.
Figure 8:
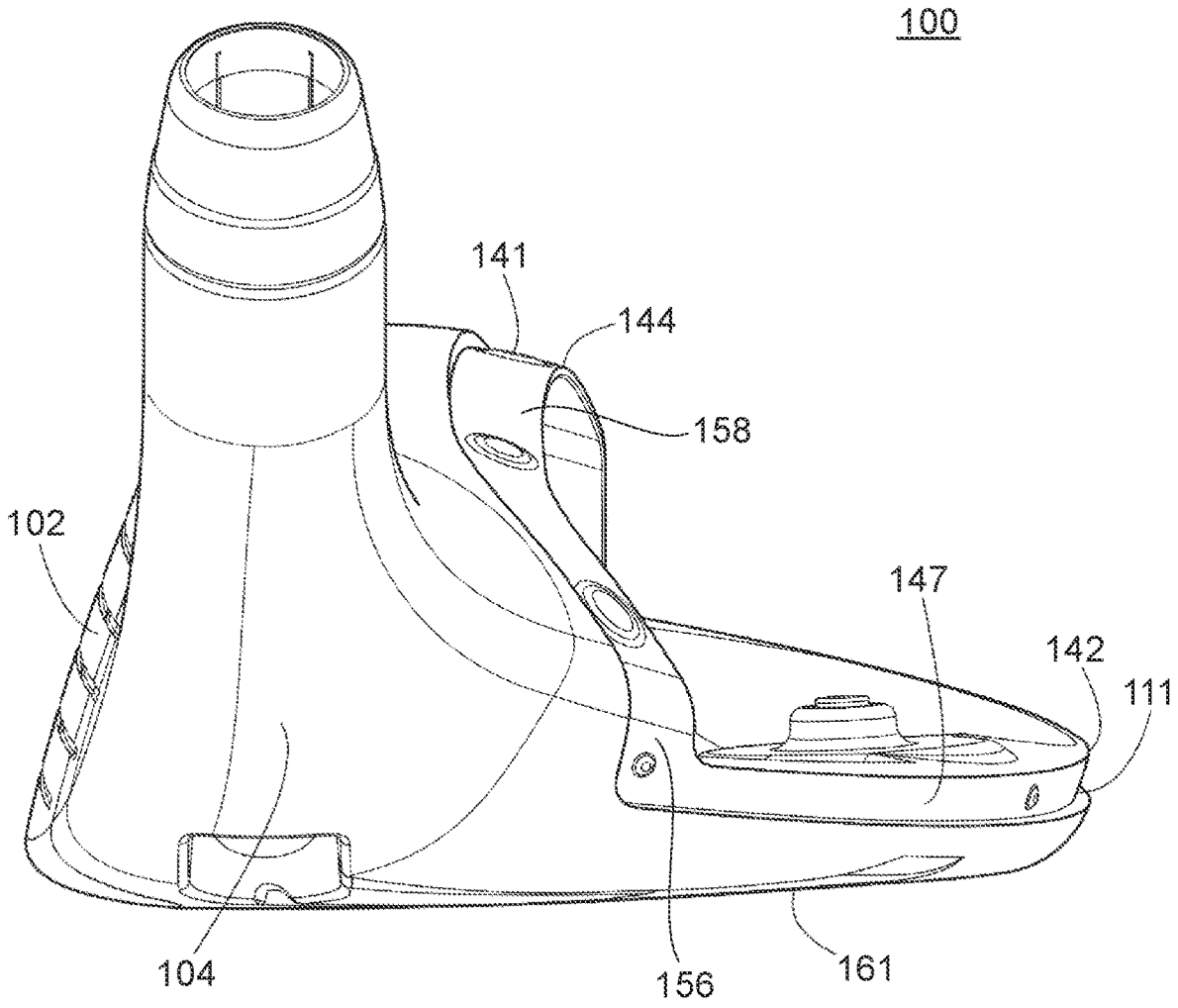
FIG. 8 illustrates a heel internal view of the golf club head of FIG. 1.
Figure 9:
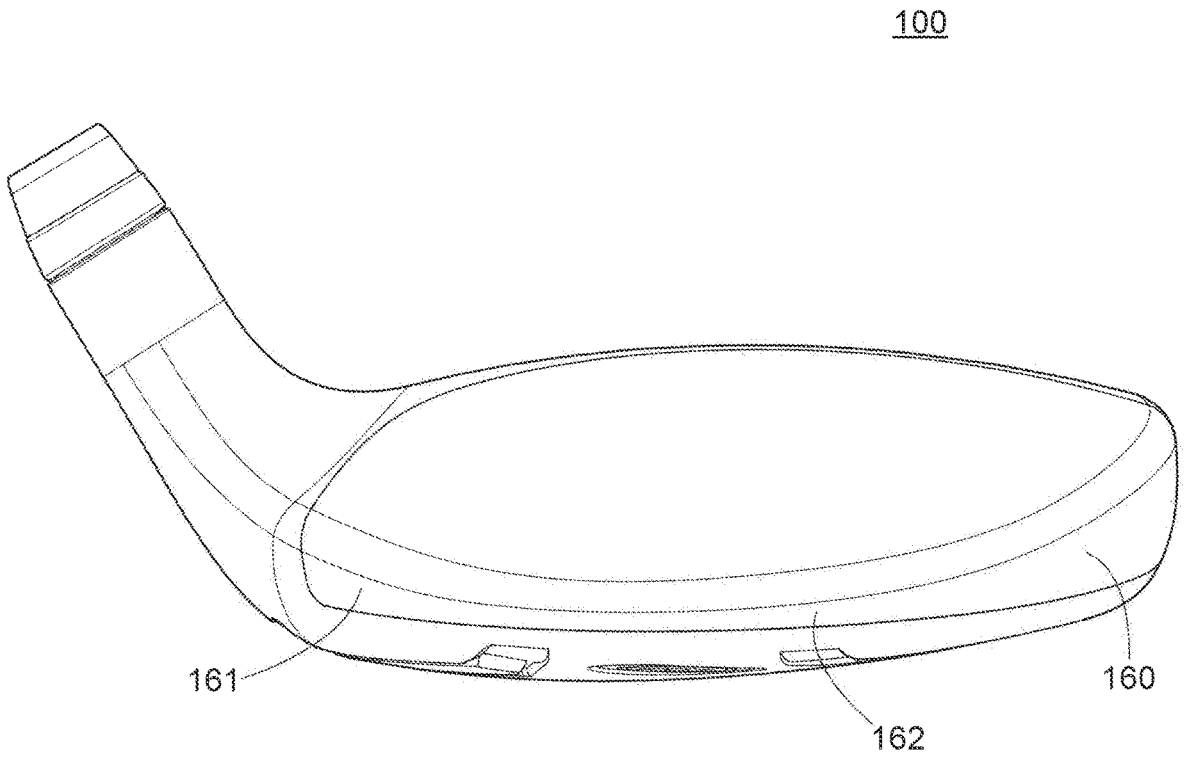
FIG. 9 illustrates a rear view of the golf club head of FIG. 1.
Figure 10:
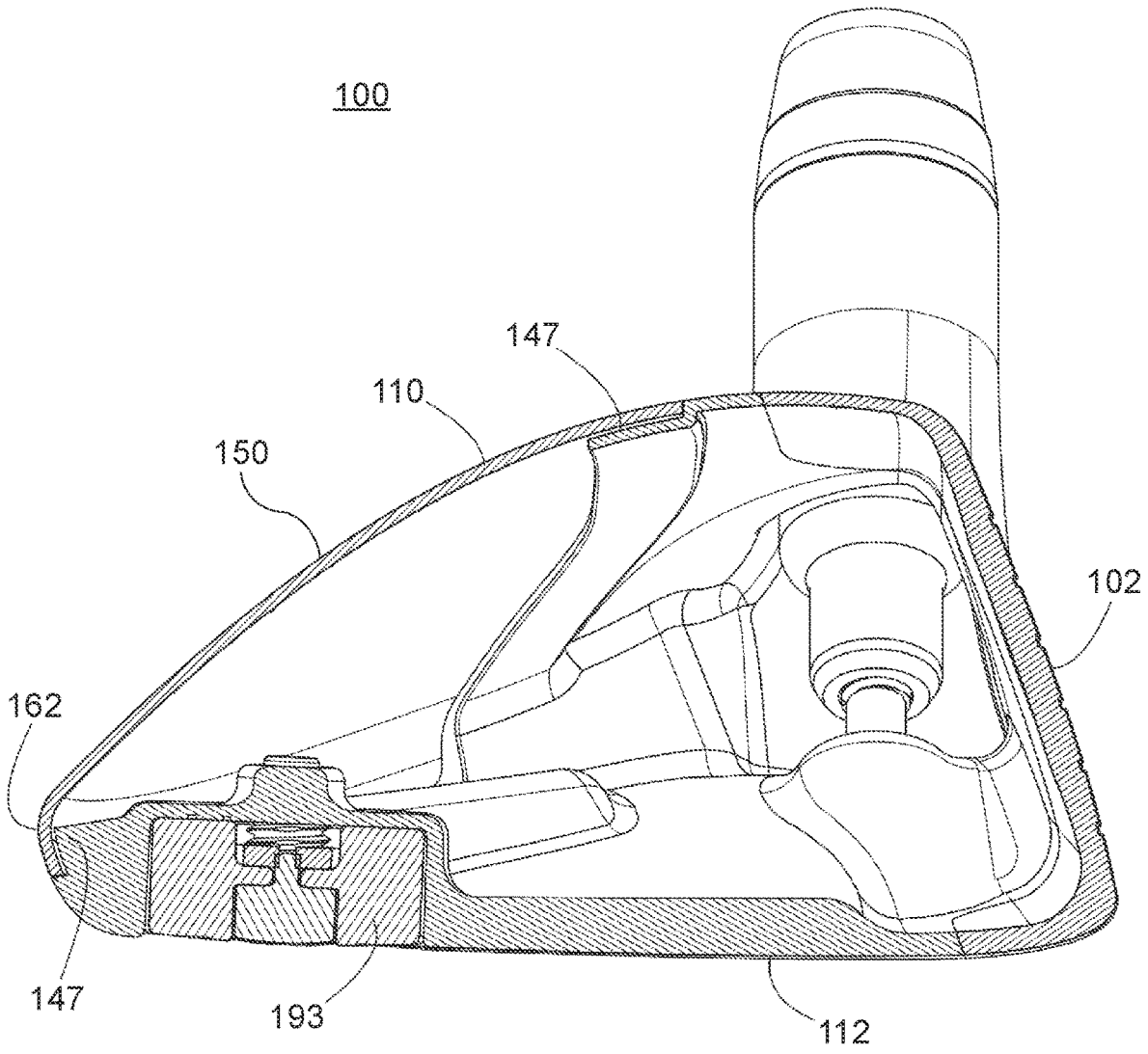
FIG. 10 illustrates a cross-sectional view of the golf club head of FIG. 1.

As illustrated in FIG. 7, the crown panel 150 can comprise a transition profile 152, or a crown panel transition profile 152, dividing the crown panel 150 and body 101 on the crown 110. In some embodiments, the transition profile 152 may be concave relative to the strike face 102. In other embodiments, as shown in FIG. 7, the transition profile 152 may be convex relative to the strike face 102. In other embodiments, the transition profile 152 may be parallel to the strike face 102. Further, the transition profile 152 may be skewed relative to the strike face 102. For example, the crown panel transition profile 152 may be skewed to be closer to the strike face 102 near the heel end 104*a* than the toe end 106*a*. Alternatively, the crown panel transition profile 152 may be skewed to be closer to the strike face 102 than near the toe end 106*a* than the heel end 104*a*.

In other embodiments, the club head 100 can comprise a crown panel 150 comprising a rear sole portion. The crown panel 150 may comprise between 3% and 16% of the sole 112 surface area. In some embodiments, the crown panel 150 can comprise between 3% and 5%, 5% and 7%, 7% and 9%, 9% and 11%, 11% and 13%, or 13% and 16% of the sole 112 surface area.

The crown panel 150 comprises a less dense material than the material of the body 101. In some embodiments, the crown panel 150 can comprise a composite formed from polymer resin and reinforcing fiber. The polymer resin can comprise a thermoset or a thermoplastic. The crown panel 150 composite can be either a filled thermoplastic (FT) or a fiber-reinforced composite (FRC). In some embodiments, the crown panel 150 can comprise a FT bonded together with a FRC. Filled thermoplastics (FT) are typically injection molded into the desired shape. As the name implies, filled thermoplastics (FT) can comprise a thermoplastic resin and randomly-oriented, non-continuous fibers. In contrast, fiber-reinforced composites (FRCs) are formed from resin-impregnated (prepreg) sheets of continuous fibers. Fiber-reinforced composites (FRCs) can comprise either thermoplastic or thermoset resin.

In embodiments with a thermoplastic resin, the resin can comprise a thermoplastic polyurethane (TPU) or a thermoplastic elastomer (TPE). For example, the resin can comprise polyphenylene sulfide (PPS), polyetheretheretherketone (PEEK), polyimides, polyamides such as PA6 or PA66, polyamide-imides, polyphenylene sulfides (PPS), polycarbonates, engineering polyurethanes, and/or other similar materials. Although strength and weight are the two main properties under consideration for the composite material, a suitable composite material may also exhibit secondary benefits, such as acoustic properties. In some embodiments, PPS and PEEK are desirable because they emit a generally metallic-sounding acoustic response when the club head is impacted.

The reinforcing fiber can comprise carbon fibers (or chopped carbon fibers), glass fibers (or chopped glass fibers), graphine fibers (or chopped graphite fibers), or any other suitable filler material. In other embodiments, the composite material may comprise any reinforcing filler that adds strength, durability, and/or weighting.

The density of the composite material (combined resin and fibers), which forms the crown panel 150, can range from about 1.15 g/cc to about 2.02 g/cc. In some embodiments, the composite material density ranges between about 1.20 g/cc and about 1.90 g/cc, about 1.25 g/cc and about 1.85 g/cc, about 1.30 g/cc and about 1.80 g/cc, about 1.40 g/cc and about 1.70 g/cc, about 1.30 g/cc and about 1.40 g/cc, or about 1.40 g/cc to about 1.45 g/cc.

Filled Thermoplastic (FT)

In some embodiments, the crown panel 150 may comprise filled thermoplastic (FT) materials. In a FT material, the polymer resin should preferably incorporate one or more polymers that have sufficiently high material strengths and/or strength/weight ratio properties to withstand typical use while providing a weight savings benefit to the design. Specifically, it is important for the design and materials to efficiently withstand the stresses imparted during an impact between the strike face and a golf ball, while not contributing substantially to the total weight of the golf club head. In general, the polymers can be characterized by a tensile strength at yield of greater than about 60 MPa (neat). When the polymer resin is combined with the reinforcing fiber, the resulting composite material can have a tensile strength at yield of greater than about 110 Mpa, greater than about 180 Mpa, greater than about 220 Mpa, greater than about 260 Mpa, greater than about 280 Mpa, or greater than about 290 Mpa. In some embodiments, suitable composite materials may have a tensile strength at yield of from about 60 Mpa to about 350 Mpa.

In some embodiments, the reinforcing fiber comprises a plurality of distributed discontinuous fibers (i.e. "chopped fibers"). In some embodiments, the reinforcing fiber comprises a discontinuous "long fibers," having a designed fiber length of from about 3 mm to 25 mm. In some embodiments the discontinuous "long fibers" have a designed fiber length of from about 3 mm to 14 mm. For example, in some embodiments, the fiber length is about 12.7 mm (0.5 inch) prior to the molding process. In another embodiment, the reinforcing fiber comprises discontinuous "short fibers," having a designed fiber length of from about 0.01 mm to 3 mm. In either case (short or long fiber), it should be noted that the given lengths are the pre-mixed lengths, and due to breakage during the molding process, some fibers may actually be shorter than the described range in the final component. In some configurations, the discontinuous chopped fibers may be characterized by an aspect ratio (e.g., length/diameter of the fiber) of greater than about 10, or more preferably greater than about 50, and less than about 1500. Regardless of the specific type of discontinuous chopped fibers used, in certain configurations, the composite material may have a fiber length of from about 0.01 mm to about 25 mm or from about 0.01 mm to about 14 mm.

The composite material may have a polymer resin content of from about 40% to about 90% by weight, or from about 55% to about 70% by weight. The composite material of the second component can have a fiber content between about 10% to about 60% by weight. In some embodiments, the composite material has a fiber content between about 20% to about 50% by weight, between 30% to 40% by weight. In some embodiments, the composite material has a fiber content of between about 10% and about 15%, between about 15% and about 20%, between about 20% and about 25%, between about 25% and about 30%, between about 30% and about 35%, between about 35% and about 40%, between about 40% and about 45%, between about 45% and about 50%, between about 50% and about 55%, or between about 55% and about 60% by weight.

In embodiments where the crown panel 150 comprises a filled thermoplastic (FT) material, the crown panel 150 can be injection molded out of composite pellets comprising both the polymer resin and the reinforcing fibers. The reinforcing fibers can be embedded within the resin prior to the injection molding process. The pellets can be melted and injected into an empty mold to form the crown panel 150. The FT composite material can have a melting temperature of between about 210° C. to about 280° C. In some embodiments, the composite material can have a melting temperature of between about 250° C. and about 270° C.

In embodiments with FT material crown panel 150, at least 50% of the fibers can be aligned roughly front-to-back in a center region of the crown 110. In other words, the fibers can be aligned roughly perpendicular to the striking face 113. FT materials exhibit greatest strength in the direction of fiber alignment. Therefore, having the fibers oriented roughly front-to-back in the crown 110 can increase the durability of the club head in the front-to-rear direction. The fiber alignment can be correspond to the direction of material flow within the mold during the injection molding process.

In some embodiments, the crown panel 150 can be formed from a long fiber reinforced TPU material (an example FT material). The long fiber TPU can comprise about 40% long carbon fiber by weight. The long fiber TPU can exhibit a high elastic modulus, greater than that of short carbon fiber compounds. The long fiber TPU can withstand high temperatures, making it suitable for use in a golf club head that is used and/or stored in a hot climate. The long fiber TPU further exhibits a high toughness, allowing it to serve well as a replacement for traditionally metal components. In some embodiments, the long fiber TPU comprises a tensile modulus between about 26,000 Mpa and about 30,000 Mpa or between about 27,000 Mpa and about 29,000 Mpa. In some embodiments, the long fiber TPU comprises a flexural modulus between about 21,000 Mpa and about 26,000 Mpa or between about 22,000 Mpa and 25,000 Mpa. The long fiber TPU material can exhibit a tensile elongation (at break) of between about 0.5% and about 2.5%. In some embodiments, the tensile elongation of the composite TPU material can be between about 1.0% and about 2.0%, between about 1.2% and about 1.4%, between about 1.4% and about 1.6%, between about 1.6% and about 1.8%, or between about 1.8% and about 2.0%.

Fiber-Reinforced Composite (FRC)

In some embodiments, the crown panel 150 may comprise fiber-reinforced composite (FRC) materials. FRC materials generally include one or more layers of a uni- or multi-directional fiber fabric that extend across a larger portion of the polymer. Unlike the reinforcing fibers that may be used in filled thermoplastic (FT) materials, the maximum dimension of fibers used in FRCs may be substantially larger/longer than those used in FT materials, and may have sufficient size and characteristics so they may be provided as a continuous fabric separate from the polymer. When formed with a thermoplastic polymer, even if the polymer is freely flowable when melted. The included continuous fibers do not flow well. The reinforcing fibers can comprise an areal weight (weight per length-by-width area) between 75 g/m2 and 150 g/m2.

FRC materials are generally formed by arranging the fiber into a desired arrangement, and then impregnating the fiber material with a sufficient amount of a polymeric material to provide rigidity. In this manner, while FT materials may have a resin content of greater than about 45% by volume or more preferably greater than about 55% by volume, FRC materials desirably have a resin content of less than about 45% by volume, or more preferably less than about 35% by volume. In some embodiments, the resin content of the FRC can be between 24% and 45% by volume.

FRC materials traditionally use two-part thermoset epoxies as the polymeric matrix, however, it is possible to also use thermoplastic polymers as the matrix. In many instances, FRC materials are pre-prepared prior to final manufacturing, and such intermediate material is often referred to as a prepreg. When a thermoset polymer is used, the prepreg is partially cured in intermediate form, and final curing occurs once the prepreg is formed into the final shape. When a thermoplastic polymer is used, the prepreg may include a cooled thermoplastic matrix that can subsequently be heated and molded into a final shape.

A FRC crown panel 150 can be comprise a plurality of layers (also called a plurality of lamina). Each layer can comprise and/or be the same thickness as a prepreg. Each layer the plurality of layers can comprise either a unidirectional fiber fabric (UD) or a multi-directional fiber fabric (sometimes called a weave). In some embodiments, the plurality of layers can comprise at least three UD layers. The second and third layers can be angled relative to a base layer. For a base layer oriented at 0 degrees, the second and third layers can be oriented at +/−45 degrees from the base layer. In some embodiments, the layers can be oriented at 0, +45, −45, +90, −90 in any suitable order. In some embodiments, the plurality of layers comprises at least one multi-directional weave layer, typically positioned as the top layer to improve the appearance of the FRC crown panel 150.

Mixed-Material

The crown panel 150 may have a mixed-material construction that includes both a fiber-reinforced composite resilient layer and a molded thermoplastic structural layer. In some preferred embodiments, the molded thermoplastic structural layer may be formed from a filled thermoplastic material (FT). As described above, the FT can comprise a discontinuous glass, carbon, or aramid polymer fiber filler embedded throughout a thermoplastic material. The thermoplastic resin can be a TPU, such as, for example, polyphenylene sulfide (PPS), polyether ether ketone (PEEK), or a polyamide such as PA6 or PA66. The fiber-reinforced composite resilient layer can comprise a woven glass, carbon fiber, or aramid polymer fiber reinforcing layer embedded in a polymeric resin (or matrix). The polymeric resin of the resilient layer can be a thermoplastic or a thermoset.

In some embodiments, the polymeric resin of fiber-reinforced composite resilient layer is the same thermoplastic material as the resin of the molded thermoplastic structural layer. In other words, the fiber-reinforced resilient layer and the molded structural layer can comprise a common thermoplastic resin. Forming the resilient and structural layers with a common thermoplastic resin allows for a strong chemical bond between the layers. In these embodiments, the resilient and structural layers can be bonded without the use of an intermediate adhesive. In one particular embodiment, the crown panel 150 resilient layer can comprise a woven carbon fiber fabric embedded in a polyphenylene sulfide (PPS), and the second component (200) structural layer can comprise a filled polyphenylene sulfide (PPS) polymer. In alternate embodiments, the crown panel 150 can be extruded, injection blow molded, 3-D printed, or any other appropriate forming means. In a different embodiment the crown panel 150 can be made from SMAC-WRAP®.

III. Weight Reducing Features

1. Light Weight Shaft Receiving Structure

As described above, the club head can comprise one or more features that create discretionary mass. The discretionary mass can be allocated to portions of the club head that provide a low and rearward CG position, resulting in higher launching golf shots. In many embodiments, the club head can comprise a lightweight shaft-receiving structure. The lightweight shaft-receiving structure creates discretionary mass that can be used to improve the club head mass properties.

Figure 11:
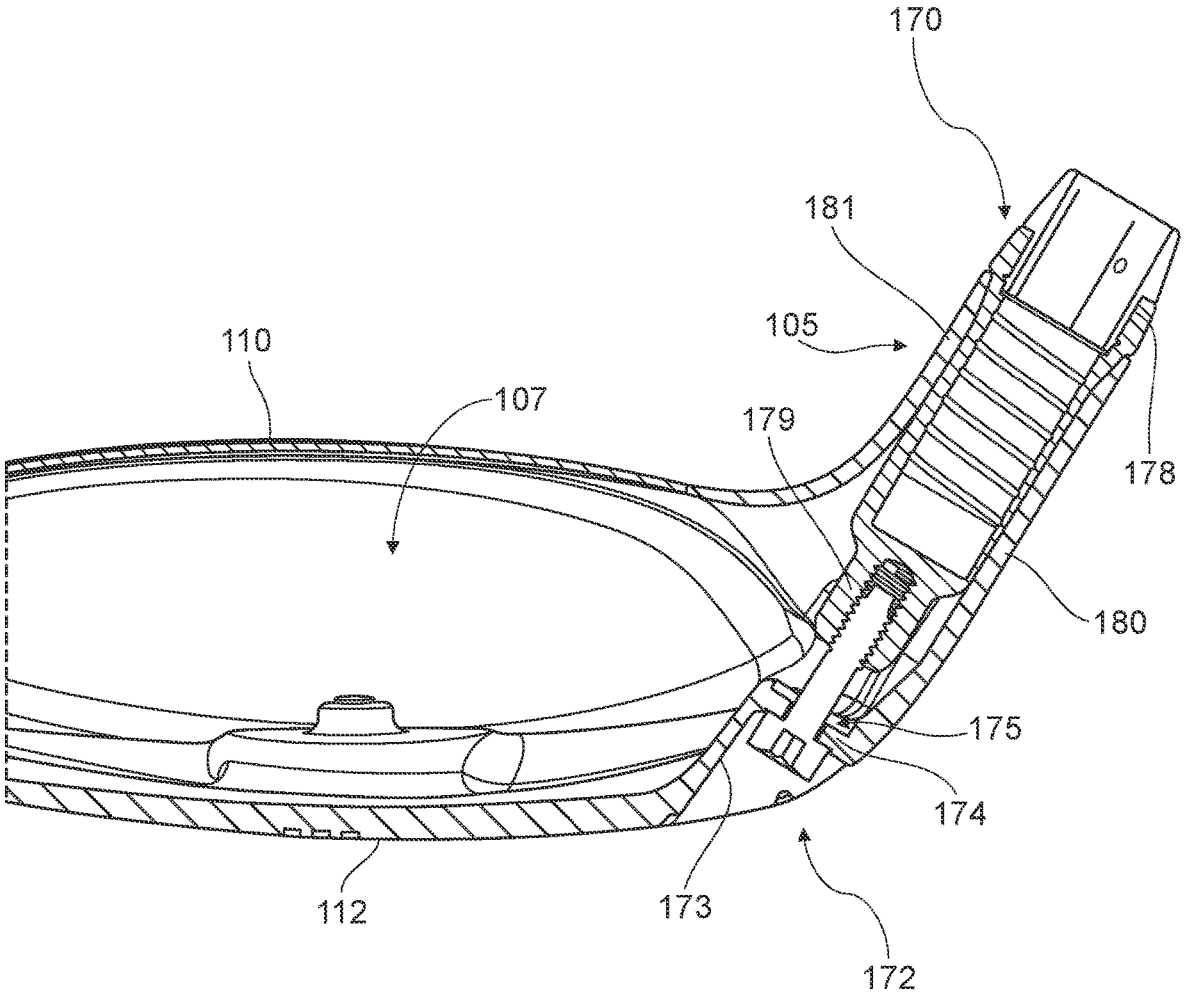
FIG. 11 illustrates a cross-sectional view of the adjustable hosel of the golf club head of FIG. 1.
Figure 12:
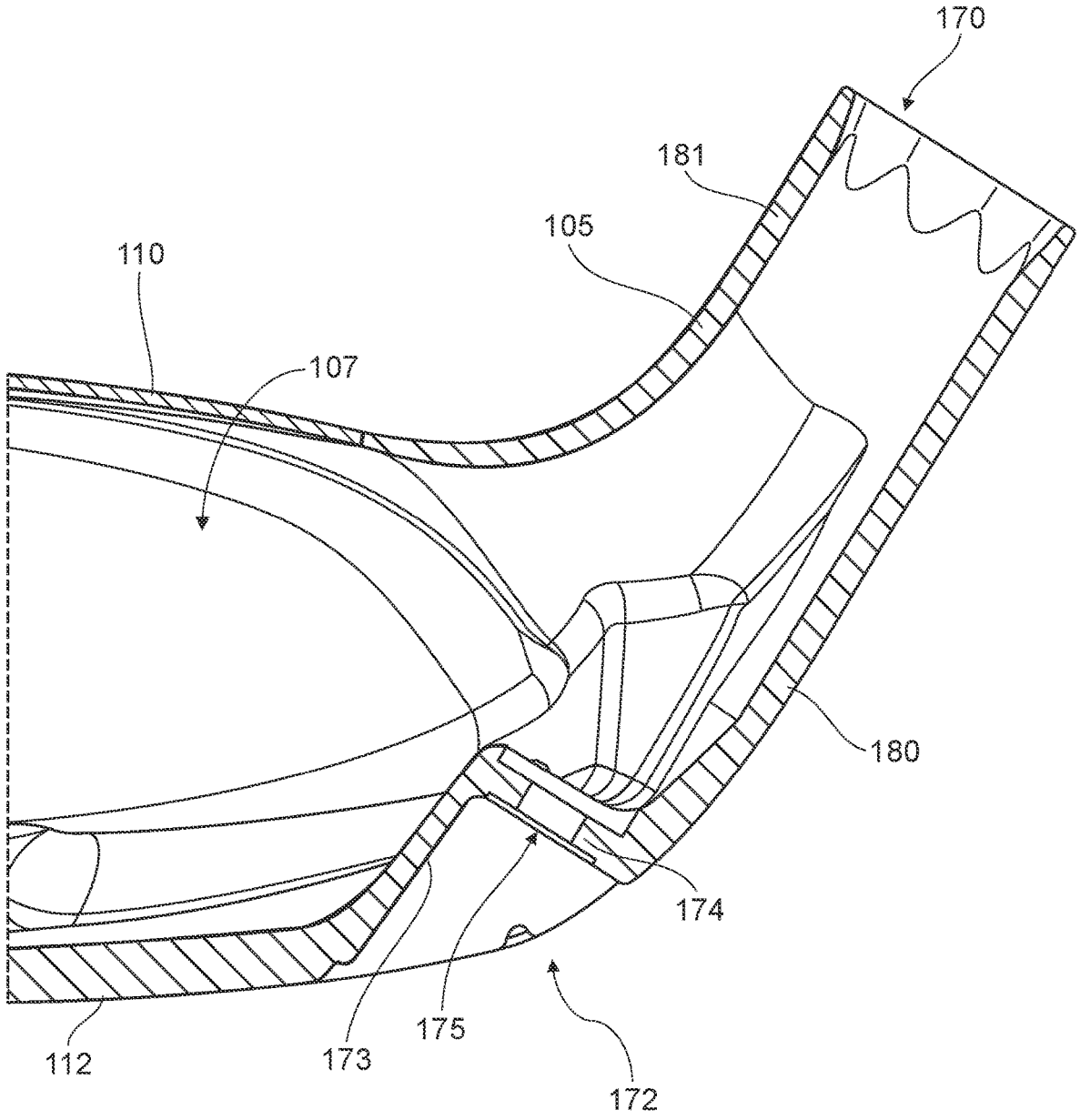
FIG. 12 illustrates a cross-sectional view of the golf club head of FIG. 1 without the shaft, shaft sleeve, and screw.
Figure 13:
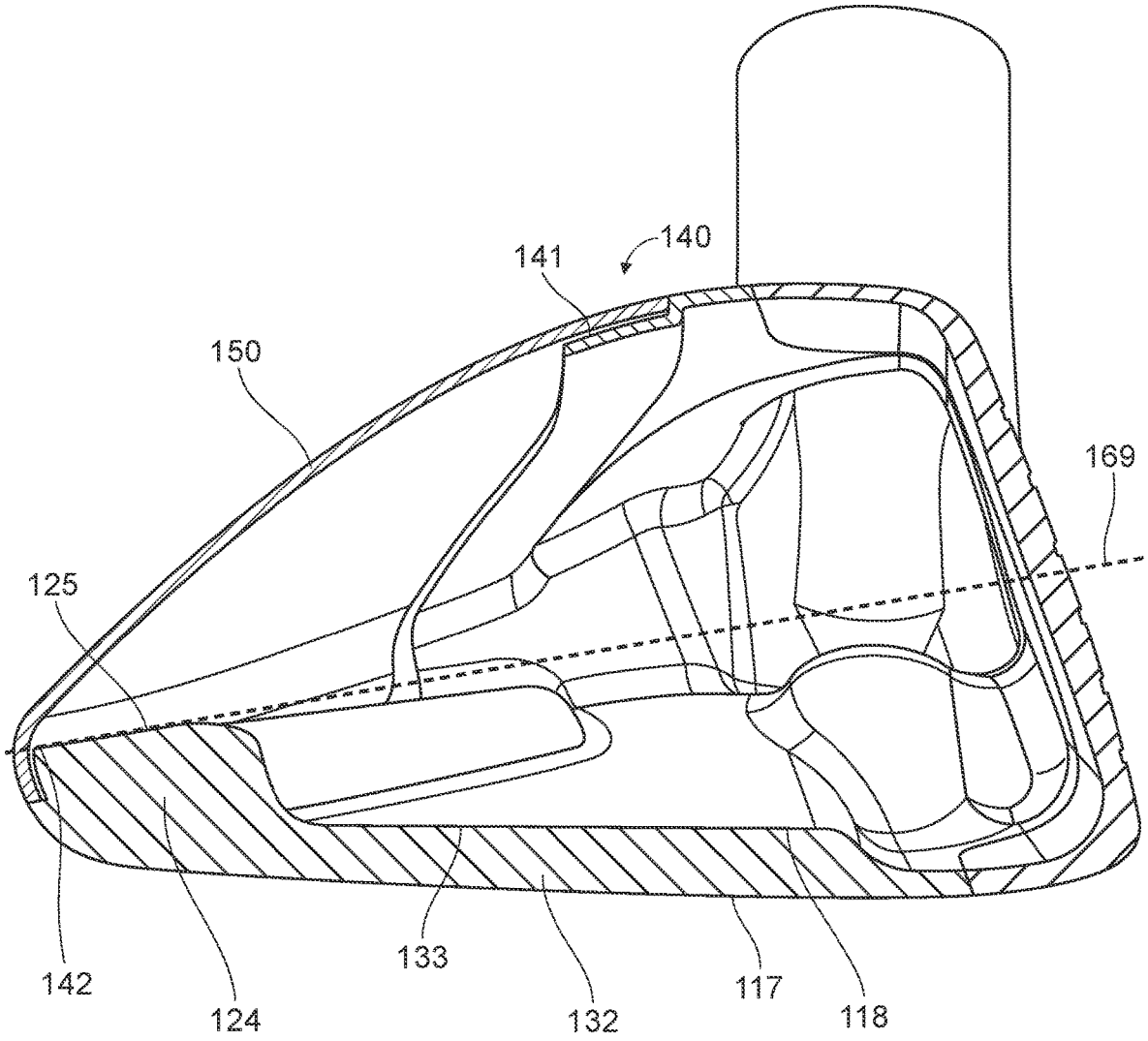
FIG. 13 illustrates a cross-sectional view of the golf club head of FIG. 1.
Figure 14:
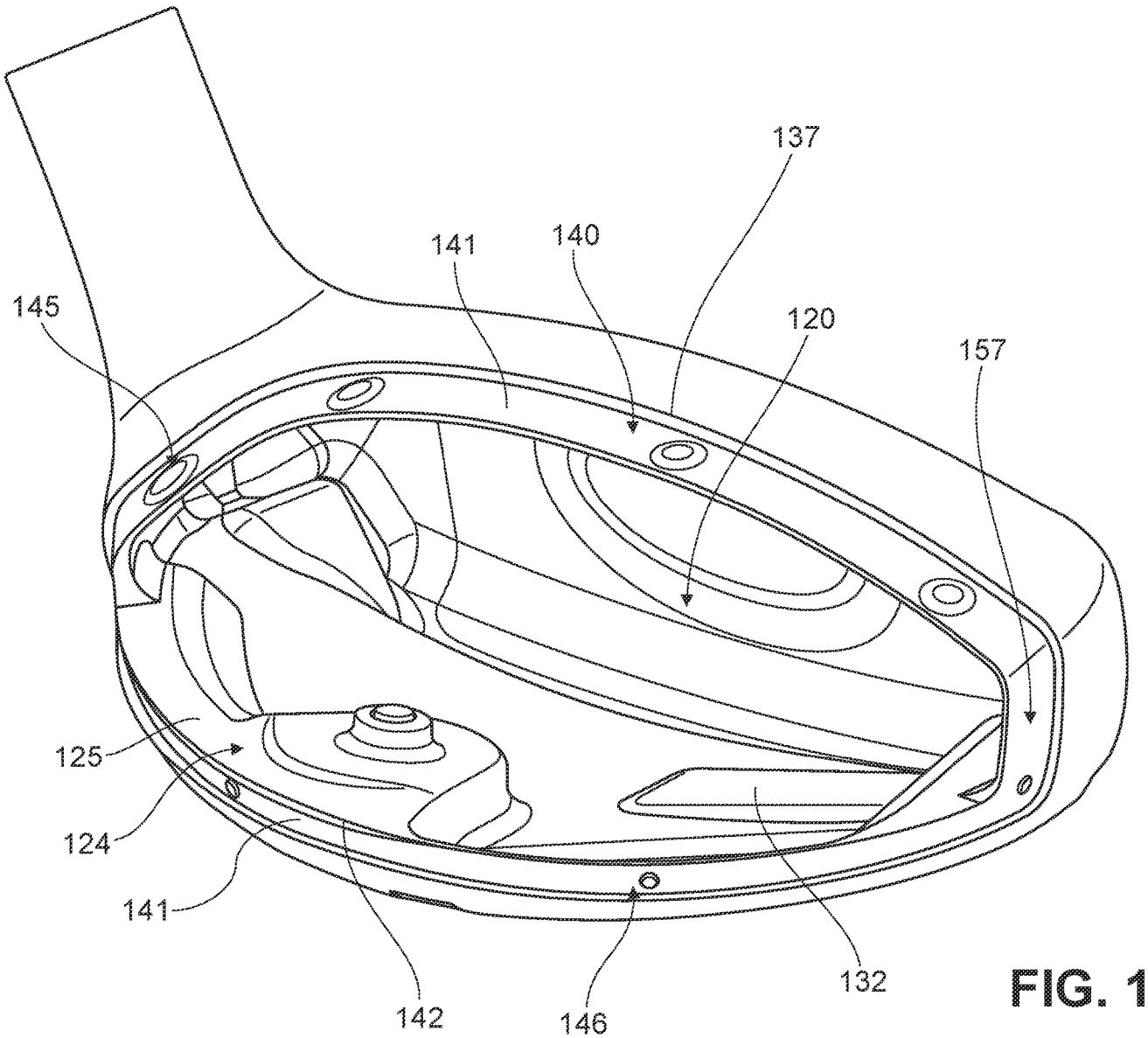
FIG. 14 illustrates a rear internal perspective view of the golf club head of FIG. 1.
Figure 15:
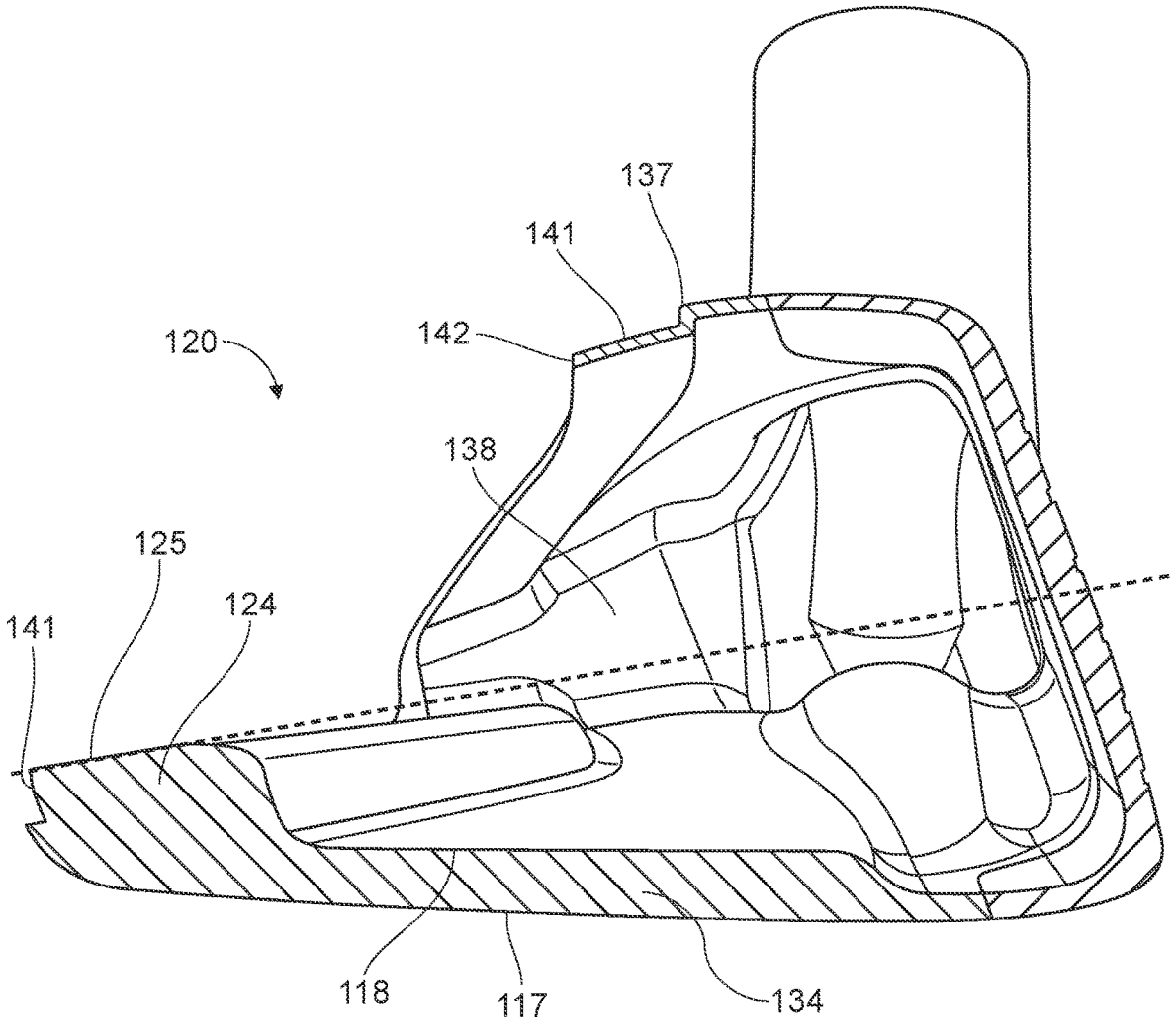
FIG. 15 illustrates a cross-sectional view of the golf club head of FIG. 1, without the crown panel.
Figure 16:
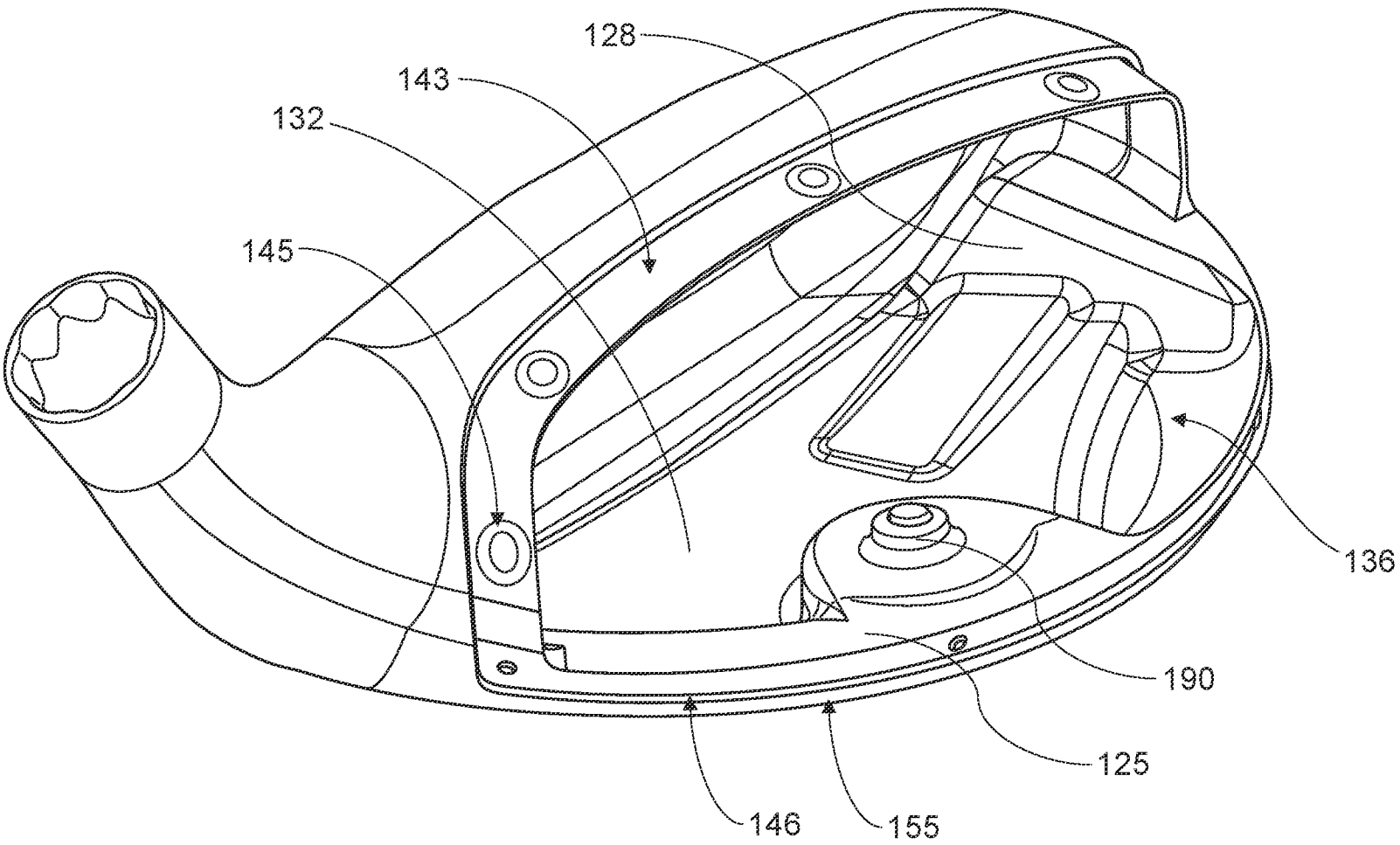
FIG. 16 illustrates a heel internal perspective view of the golf club head of FIG. 1.

Referring to FIGS. 11 and 12, the light weight shaft receiving structure comprises the hosel 105, a shaft sleeve 178, and a screw 176. In many embodiments, at least a portion of the shaft sleeve 178 is exposed to the interior cavity 107. In many embodiments, at least a portion of a shaft sleeve tip 179 is exposed to the interior cavity. In the present embodiment, rather than being retained by an internal structure such as a hosel tube, the shaft sleeve 178 is retained in the club head by structures that also form at least a portion of the club head body exterior. In other words, the shaft sleeve 178 is primarily supported and retained by portions of the hosel wall such as the hosel crown wall 181 and hosel heel wall 180. In many embodiments, the shaft receiving structure comprises an upper end and a lower end. In the tubeless embodiment, the shaft sleeve 178 is secured only at the upper end and the lower end. The shaft sleeve is inserted through the hosel bore opening 170 and retained at the upper end by the hosel heel wall 180, and the hosel crown 181. The shaft sleeve 178 can be secured to the club head by use of a fastener. The fastener is inserted through an aperture 175 through the lower recess bottom wall 174 and couples to the shaft sleeve tip 179 of the shaft sleeve 178. The lower recess is defined by a lower recess bottom wall 174 and lower recess bottom wall 174 on the heel end of the sole. The shaft sleeve 178 is not supported or retained by a hosel tube between the upper end and the lower end.

The light weight shaft-receiving structure can create 3 to 12 grams of discretionary mass in comparison to a similar shaft-receiving structure comprising a hosel tube. In some embodiments, the light weight shaft-receiving structure can create between 3 grams and 5 grams, between 4 grams and 6 grams, between 5 grams and 7 grams, between 6 grams and 8 grams, between 7 grams and 9 grams, between 8 grams and 10 grams, between 9 grams and 11 grams, or between 10 grams and 12 grams of discretionary mass in comparison to a similar shaft-receiving structure comprising a hosel tube. In some embodiments, the light weight shaft-receiving structure can create greater than 3 grams, greater than 4 grams, greater than 5 grams, greater than 6 grams, greater than 7 grams, greater than 8 grams, greater than 9 grams, or greater than 10 grams of discretionary mass in comparison to a similar shaft-receiving structure comprising a hosel tube. Reducing the mass of the shaft-receiving structure by eliminating the hosel tube frees up discretionary mass to be re-allocated to other areas of the club head to improve mass properties and provide higher launching golf shots.

Due to the lack of a hosel tube, the light weight shaft-receiving structure does not comprise a continuous hosel bore. In other words, light weight shaft receiving structure does not comprise a hosel bore extending all the way from the hosel bore opening to the lower recess 172. As illustrated in FIGS. 11 and 12, the hosel bore opens to the interior cavity 107. The hosel bore can be formed by the interior surface of the hosel wall upper portion. In many embodiments, the hosel bore can extend from the hosel bore opening 170, which is formed by the upper edge of the hosel wall upper portion, to the bottom of the hosel wall upper portion. In other embodiments, a portion of the hosel bore can be formed by the hosel wall. The hosel bore can transition, either abruptly or gradually, into the interior cavity. The hosel bore transitions into the interior cavity as the hosel wall diverges from the shaft sleeve.

The light weight shaft-receiving structure provides a maximum amount of discretionary mass (between 3 grams and 12 grams) to be redistributed about the club head. The light weight shaft receiving structure comprises minimal structure due to the elimination of the hosel tube. As described above, the elimination of the hosel tube is possible due to the lack of structural benefit provided by prior art hosel tubes. In many embodiments, as described above, the discretionary mass created by the light weight shaft-receiving structure can be added to a mass pad on the sole to improve the club head CG location, and/or to a removable weight near the rear of the club head to increase the club head MOI. The shaft-receiving structure provides a minimal amount of mass and structure without sacrificing durability.

2. Reduced Fastener and Bore Size

Further, certain walls of the lightweight shaft-receiving structure can have reduces thickness, thereby reducing further the mass of the shaft-receiving structure. To reduce the mass of the lightweight shaft-receiving structure, the hosel heel wall 180, and the hosel crown wall 181 and lower recess side wall 173, recess bottom wall 174 can be substantially thin. The hosel wall can comprise a minimum hosel wall thickness between 0.040 inch and 0.080 inch. In many embodiments, the hosel wall can comprise a minimum hosel wall thickness less than 0.080 inch, less than 0.075 inch, less than 0.070 inch, less than 0.065 inch, less than 0.060 inch, less than 0.055 inch, less than 0.050 inch, less than 0.045 inch, or less than 0.040 inch. Providing a substantially thin hosel wall creates discretionary mass over a club head comprising thicker walls that provide support to the shaft-receiving structure.

Referring to FIGS. 11 and 12, the lower recess 172 is recessed in relation to the surface of the sole. The lower recess is defined by a lower recess side wall 173 that connects the surface of the sole to the lower recess bottom wall 174. The lower recess wall can surround a significant portion of the lower recess 172. In many embodiments, the lower recess bottom wall 174 can converge with the hosel heel wall 180 proximate the heel end, such that the a portion of the lower recess 172 connects directly to the hosel wall on the heel end. The inclusion of the lower recess wall allows the lower recess 172 to be inset from the surface of the sole and creates the lower opening. Providing the lower opening allows the head of the fastener to be spaced away from the sole surface, such that the fastener does not come in contact with the ground during the golf swing.

To reduce the mass of the lightweight shaft-receiving structure, the lower recess wall can be substantially thin. The lower recess wall can comprise a minimum recess wall thickness between 0.020 inch and 0.050 inch. In many embodiments, the lower recess wall can comprise a minimum recess wall thickness less than 0.050 inch, less than 0.045 inch, less than 0.040 inch, less than 0.035 inch, less than 0.030 inch, less than 0.025 inch, or less than 0.020 inch. Providing a substantially thin lower recess wall creates discretionary mass over a club head comprising thicker walls that provide support to the shaft-receiving structure.

IV. Launch Characteristics

1. Shallow Face

The golf club head can further comprise features to improve face flexure while simultaneously increasing discretionary mass. To improve face flexure, the golf club head can comprise a relatively shorter face height. The shorter face height will allow the face to be made thinner. The face thickness is the primary factor which affects ball speed and as such, by thinning the face, ball speed will increase. The shortened (i.e., shallow) face height improves ball speed so that the club head can maintain carry distance while achieving a higher peak height. The shallow face further increases discretionary mass.

The golf club head comprising a shallow (shorter) face further increases discretionary mass. By reducing the dimensions (height and thickness) of the strike face, less mass is used to form the strike face. In some embodiments, the shallow face can save approximately 2-10 grams that can allocated to other portions of the club head to increase the moment of inertia and/or lower the center of gravity.

Figure 5:
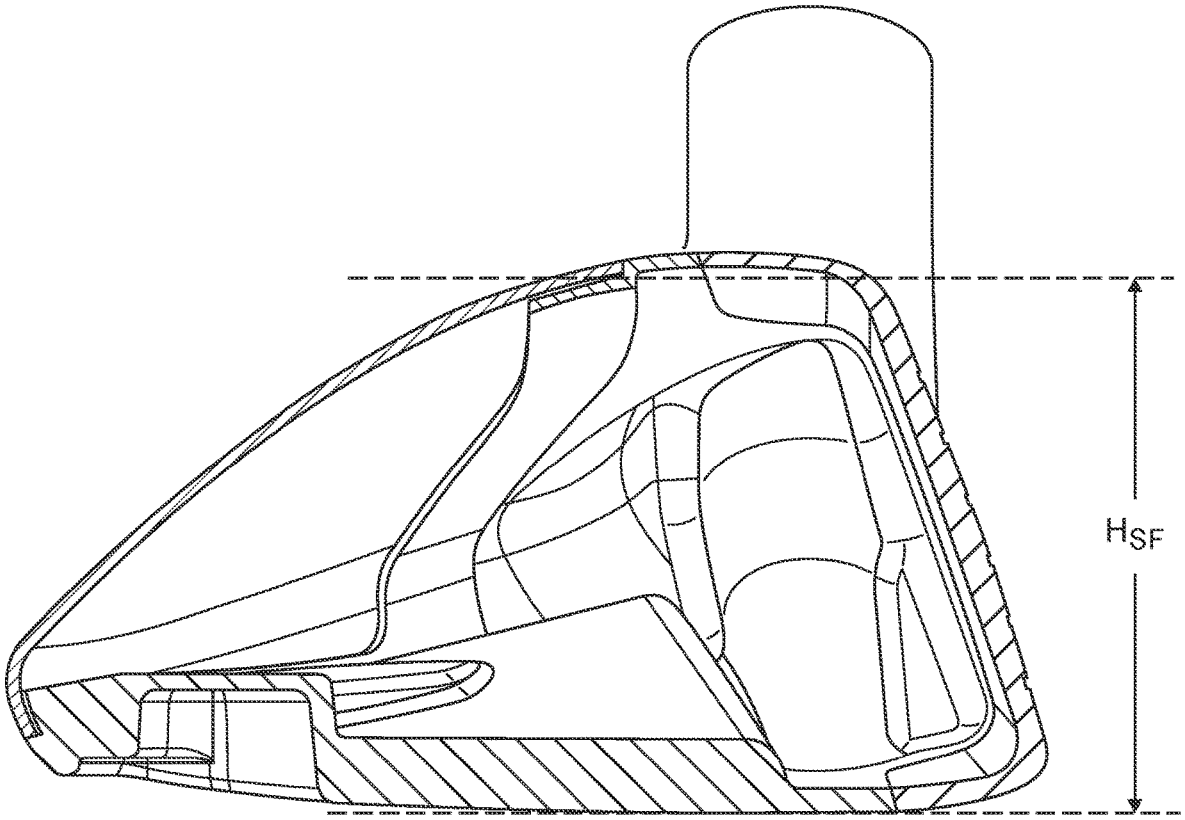
FIG. 5 illustrates a cross-sectional view of the golf club head of FIG. 1.

As illustrated in FIG. 5, the golf club head comprises a face height $H_{SF}$, measured from the ground plane to the top of the face, at the point where the face transitions from the bulge and roll profile to the crown curvature. In some embodiments, the face height $H_{SF}$ of the golf club head can range from approximately 1.10 inches to 1.25 inches. For example, the face height $H_{SF}$ can range from approximately 1.10 inch to 1.15 inches, 1.15 inches to 1.20 inches, or 1.20 inches to 1.25 inches. The face height of an embodiment is approximately 1.20 inches.

In some embodiments, the face thickness of the club head can have a variable thickness profile. As such, the club head comprises a maximum face thickness and a minimum face thickness. The maximum face thickness can range from approximately 0.069 inch to 0.075 inch. The minimum face thickness can range from approximately 0.055 inch to 0.065 inch. In one embodiment, the maximum face thickness is approximately 0.071 inch and the minimum face thickness is approximately 0.058 inch. The face thickness of the present invention can be made thinner (0.005-0.010 inch) due to the reduction in face height, as described above.

2. Loft Adjustments

Improving the Iyy/CGy ratio from the use of the mass pads described above can allow for loft adjustments to achieve a higher launch angle because ball speed is improved. Having an improved CGy location can increase ball speed and carry distance by aligning the CG with the force line. As such, the loft angle can increase to increase launch angle, thereby improving the stopping power of the hybrid-type club head and allowing the player to hold greens easier to leave shorter puts and reduce strokes. As mentioned above, increasing the launch angle while maintaining or increasing carry distance is achieved through the arrangement of the various mass pads, which form a portion of the lap joint, and other mass saving features.

Any of the features described above can be used together in any combination to provide a desired amount of discretionary mass that may be allocated to the rear mass pad 124, toe mass pad 128, heel mass pad 138, or sole mass pad 132, to improve the Iyy/CGy ratio. In one embodiment, the golf club head can comprise a lightweight shaft receiving structure, a light weight hosel wall, shallow face, and mass pad forming the lap joint. In other embodiments, the golf club head can comprise any combination of the aforementioned features to provide a golf club head a low center of gravity and/or high moment of inertia so that the launch angle and carry distance of the ball is increased. The low center of gravity can increase ball speed by moving the center of gravity closer to the force line of the impact.

The golf club head 100 can have any one or combination of the above specified features in a fairway-type golf club head. The fairway-type club head can achieve similar performance gains as discussed above.

V. Example 1 (Mass Properties Comparison)

In a first performance, example the CGy and Iyy properties of a first exemplary club head and a second exemplary club head were compared to a first control club head, a second control club head, a third control club head, and a fourth control club head. The first exemplary club head and the second exemplary club head comprised features similar to club head 100 described above; including a toe mass pad and a rear mass pad, wherein a rear mass pad top surface and a toe mass pad top surface were co-planar with a rear body lap joint edge and a lap joint top surface. The toe mass pad top surface, the rear mass pad top surface, the rear body lap joint edge, and the lap joint top surface all fell within the periphery plane. The periphery plane intersected the rearward most point of the club head. Further, the rear mass pad and the toe mass pad comprised approximately 60% of a rear lap joint surface area. The first/second exemplary club head further comprised 16 grams from the rear mass pad and 2 grams from the toe mass pad that were located within a 0.42 inch mass pad peripheral distance as defined above. These features allowed for the CGy to be lowered with a reduction of Iyy that was less than expected.

The difference between the first exemplary club head and the second exemplary club head was the position of the CGy and the Iyy. The first exemplary club head prioritized Iyy and located more discretionary mass proximate the periphery of the club head via mass pads. The second exemplary club head prioritized CGy and located more discretionary mass proximate the sole. The different CGy and Iyy were achieved by changing the amount the lap joint comprises the mass pads. The first control club head, the second control club head, the third control club head, and the fourth control club head, comprised conventional golf club head constructions wherein the CGy and Iyy varied between club heads. The control club heads were devoid of the top surfaces and rear edge that were co-planar, the mass pads that comprised 60% of the rear lap joint surface area, and 18 grams of mass pad mass located within a 0.42 inch mass pad peripheral distance. The control club heads had mass pads that were centrally located within the club head. The first control club head had a −3.84 mm CGy and a 294.92 kg·mm$^2$ Iyy. The second control club head had a −4.24 mm CGy and a 286.97 kg·mm$^2$ Iyy. The third control club head had a −5.16 mm CGy and a 271.49 kg·mm$^2$ Iyy. The fourth control club head had a −6.25 mm CGy and a 245.42 kg·mm$^2$ Iyy.

Figure 21:
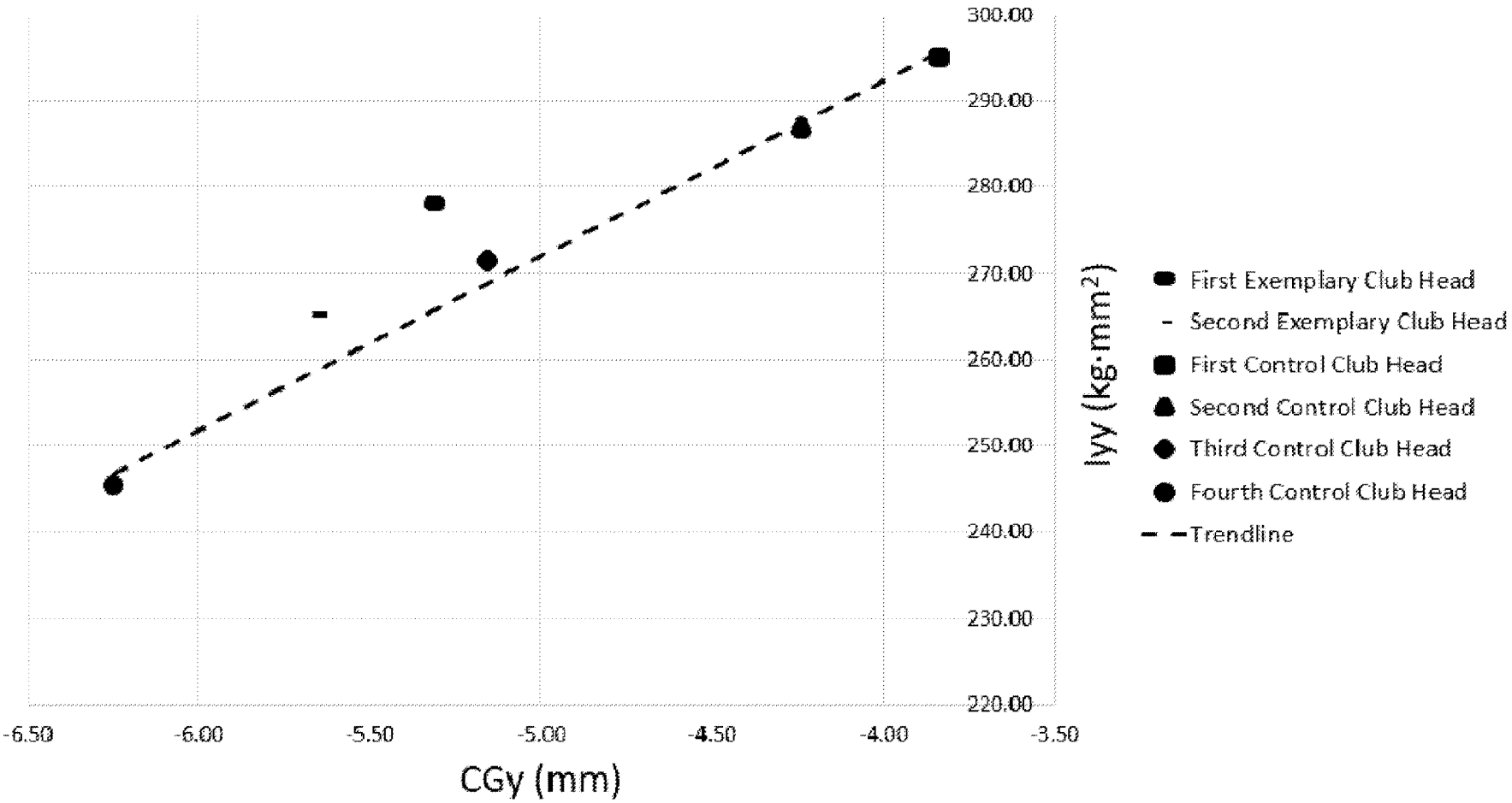
FIG. 21 illustrates a graph comparing the Iyy and CGy of exemplary club heads to control club heads.

FIG. 21, is a chart plotting CGy vs. Iyy for each of the club heads. A trendline was formed between the first control club head, the second control club head, the third control club head, and the fourth control club head. The trend line represents the relationship between CGy and Iyy of the control club heads. The equation for the trendline was y=20.275(x)+373.46. As shown in FIG. XX, the first exemplary club head and the second exemplary club head do not fall on the trendline for the conventional club heads. The first exemplary club head had a −5.31 inch CGy and a 278.06 kg·mm$^2$ Iyy. The second exemplary club head had a −5.66 inch CGy and a 265.16 kg·mm$^2$ Iyy. Based on the trendline, one would expect the first exemplary club head, with a −5.31 mm CGy to have an Iyy of 265.83 kg·mm$^2$. Additionally, based on the trendline one would expect the second exemplary club head, with a −5.66 CGy to have an Iyy of 258.62 kg·mm$^2$. Thus, the first exemplary club head, comprising the top surfaces and rear edge that were co-planar, the mass pads that comprised 60% of the rear lap joint surface area, and 18 grams of mass pad mass located within a 0.42 inch mass pad peripheral distance, resulted in a 4.6% gain in Iyy over a configuration devoid of the top surfaces and rear edge that were co-planar, the mass pads that comprised 60% of the rear lap joint surface area, and 18 grams of mass pad mass located within a 0.42 inch mass pad peripheral distance. Further, the second exemplary club head, comprising the top surfaces and rear edge that were co-planar, the mass pads that comprised 60% of the rear lap joint surface area, and 18 grams of mass pad mass located within a 0.42 inch mass pad peripheral distance, resulted in a 2.53% gain in Iyy over a configuration devoid of the top surfaces and rear edge that were co-planar, the mass pads that comprised 60% of the rear lap joint surface area, and 18 grams of mass pad mass located within a 0.42 inch mass pad peripheral distance.

The top surfaces and rear edge that were co-planar, the mass pads that comprised 60% of the rear lap joint surface area, and 18 grams of mass pad mass located within a 0.42 inch mass pad peripheral distance, provide golf club designers the opportunity to decrease the CGy of a golf club head and increase Iyy of the golf club head. A golf club head comprising a low CGy launches a golf ball higher after impact. The higher launch is advantageous as it will result in a greater decent angle and increases stopping power as will be discussed in the second performance example. It is known that as the CGy of the golf club head decreases (moves closer to the ground plane) the Iyy also decreases. Iyy is important as it provides players with forgiveness on off center strikes. Therefore, a balance between a low CGy and a high Iyy is required. Thus, the first exemplary club head and the second exemplary club head structures further provide golf club head designers with the opportunity to increase the Iyy relative to a golf club head devoid of these structures comprising the same CGy.

VI. Example 2 (Player Test Stopping Power and Launch)

In a second performance example, the resulting carry distance, total distance, roll distance spin rate, launch angle, maximum ball flight height, landing angle, and stat area were compared between the first exemplary club head and the second control club head. The second performance test consisted of twenty players hitting ten shots with the first exemplary club head and ten shots with the second control club head. At the conclusion of the test, the data for each club was averaged. The first exemplary club head having the top surfaces and rear edge that were co-planar, the mass pads that comprised 60% of the rear lap joint surface area, and 18 grams of mass pad mass located within a 0.42 inch mass pad peripheral distance, had a −5.31 mm CGy and a 278.06 kg·mm$^2$ Iyy. The second control club head, devoid of the top surfaces and rear edge that were co-planar, the mass pads that comprised 60% of the rear lap joint surface area, and 18 grams of mass pad mass located within a 0.42 inch mass pad peripheral distance, had a −4.24 mm CGy and a 286.97 kg·mm$^2$ Iyy.

The first exemplary club head resulted in a 224.2 yard carry distance, a 238.3 yard total distance, a 14.1 yard roll distance, a 4125 RPM spin rate, a 11.8 degree launch angle, a 30.6 yard maximum ball flight height, a 39.6 degree landing angle, and a 1426.4 square yard stat area. The second control club head resulted in a 225.5 yard carry distance, a 247.1 yard total distance, a 21.6 yard roll distance, a 3562 RPM spin rate, a 10.1 degree launch angle, a 24.7 yard maximum ball flight height, a 33.8 degree landing angle and a 1535.2 square yard stat area. Therefore, the first exemplary club head had 1.3 yards less carry distance, 8.8 yards less total distance, 7.5 yards less of roll distance, a 1.7 degree increase in launch, 5.3 yards increase in maximum ball flight height, a 5.8 degree increase in landing angle and a 108.8 square yard decrease in stat area. The first exemplary club head proved a low CGy club head that increases Iyy, relative to a club head having the same CGy as discussed above in the first example, provides advantageous performance characteristics. The data collected in the second example show the reduced CGy of the first exemplary club head provides a higher launch, a higher peak height, and a decrease in the roll distance, while maintaining if not improving the stat area, as compared to the second control club head which had a 8.91 kg·mm$^2$ higher Iyy than the first exemplary club head, thus even further showing the importance of the smooth lap joint an the mass pad forming a portion of the lap joint.

VII. Example 3 (FEA Short Face Ball Speed Increase)

In a third performance example, internal energies resulting from impacts were compared among a third exemplary club head, and the second control club head. The third performance test used simulated impacts on the geometric center of the third exemplary club head and the second control club head with a golf ball traveling at 100 MPH. The third exemplary club head comprised a 1.33 inch face height, a maximum face thickness of 0.71 inch and a minimum face thickness of 0.58 inch. The second control club head comprised a 1.41 inch face height, a maximum face thickness of 0.08 inch and a minimum face thickness of 0.66 inch. The third exemplary club head and the fourth exemplary club head comprised identical 19 degree lofts. The third exemplary club head had 0.009 inch thinner maximum face thickness, a 0.008 inch thinner minimum face thickness, and a 0.08 reduction in face height relative to the second control club head. If not for the reduction in face height, the thinner face of the third exemplary club head would not pass durability requirements. The shorter and thinner face of the third exemplary club head an increased internal energy.

The third performance test results were as follows: the third exemplary club head had an internal energy of 55.6 lbf-inch; and the second control club head had an internal energy of 46.4 lbf-inch. The third performance test proved in simulation that for similar test impacts, the third exemplary club head had increased internal energy relative to the second control club head. The third exemplary club head had 9.2 lbf-inch more internal energy than the first control club head. This increase in internal energy will yield approximately 0.25 to 4 MPH in additional ball speed.

VIII. Example 4 (FEA Additional Degree of Loft and Short Face Loss of 0.7 MPH Instead of 1.6 MPH)

In a fourth performance example, ball speeds resulting from impacts were compared among a fourth exemplary club head, and the second control club head. The fourth performance test used simulated impacts on the geometric center of the third exemplary club head and the second control club head with a golf ball traveling at 100 MPH. The fourth exemplary club head comprised a 1.33 inch face height, a maximum face thickness of 0.71 inch, a minimum face thickness of 0.58 inch, and a 20 degree loft. The second control club head comprised a 1.41 inch face height, a maximum face thickness of 0.08 inch, a minimum face thickness of 0.66 inch, and a 19 degree loft. The fourth exemplary club head had 0.009 inch thinner maximum face thickness, a 0.008 inch thinner minimum face thickness, and a 0.08 reduction in face height relative to the second control club head. If not for the reduction in face height, the thinner face of the fourth exemplary club head would not pass durability requirements. It is understood that an increase of 1 degree of loft between golf club heads comprising identical face heights, and thickness, other structural features, and mass properties results in a 1.66 MPH loss in ball speed. The fourth exemplary club head had a 0.70 MPH loss in ball speed relative to the second control club head. Therefore, the fourth exemplary club's shorter and thinner face reduced the loss in the ball speed from increasing the loft by one degree.

IX. Example 5 (Prospective Player Test)

A player performance test is being performed to compare carry distance, total distance, roll distance spin rate, launch angle, maximum ball flight height, landing angle, and stat area. The test compares a fifth exemplary club head to the second control club head. The fifth exemplary club head is similar to club head 100 described above and comprises a −5.31 mm CGy, a 278.06 kg·mm$^2$ Iyy, a 1.33 inch face height, a maximum face thickness of 0.71 inch, a minimum face thickness of 0.58 inch, and a 20 degree loft. The fifth exemplary club head comprises a toe mass pad and a rear mass pad, wherein a rear mass pad top surface and a toe mass pad top surface are co-planar with a rear body lap joint edge and a lap joint top surface. The toe mass pad top surface, the rear mass pad top surface, the rear body lap joint edge, and the lap joint top surface fall within the periphery plane. The periphery plane intersects the rearward most point of the club head. Further, the rear mass pad and the toe mass pad comprise approximately 60% of a rear lap joint surface area. The fifth exemplary club head comprises 16 grams from the rear mass pad and 2 grams from the toe mass pad located within a 0.42 inch mass pad peripheral distance as defined above. The second control club head comprises a −4.24 inch CGy, a 286.97 kg·mm$^2$ Iyy, a 1.41 inch face height, a maximum face thickness of 0.08 inch, a minimum face thickness of 0.66 inch, and a 19 degree loft. The second control club head is devoid of the top surfaces and rear edge being co-planar, the mass pads that comprise 60% of the rear lap joint surface area, and 18 grams of mass pad mass located within a 0.42 inch mass pad peripheral distance. The second control club head has mass pads that are centrally located within the club head.

The player performance test shows the fifth exemplary club head to have the same carry distance as the second control club head. Further, the player performance test shows the fifth exemplary club head to retain the advantages the first exemplary club head provided, as described in example 2. These include the, 7.5 yards less of roll distance, a 1.7 degree increase in launch, 5.3 yards increase in maximum ball flight height, a 5.8 degree increase in landing angle and a 108.8 square yard decrease in stat area. This is achieved by the fifth exemplary club head's shorter thinner face providing more ball speed (as discussed in examples 3 and 4) therefore increasing the fifth exemplary club head's carry distance. The fifth club head maintains the same advantages as the first exemplary club head due to the top surfaces and rear edge that are co-planar, the mass pads comprising 60% of the rear lap joint surface area, and 18 grams of mass pad mass located within a 0.42 inch mass pad peripheral distance providing a low CGy and increasing Iyy relative to a club head having the same CGy as discussed above in the first example.

Clause 1: A golf club head, comprising: a body comprising a toe end, a heel end, a rear end, a crown, a sole, and a strike face comprising a geometric center; a center of gravity; wherein: a loft plane is defined tangent to the strike face at the geometric center; a ground plane is defined tangent to the sole when the body is in an address position; a loft angle is defined by the loft plane and the ground plane; the loft angle is in a range of 15 degrees to 35 degrees; an x-axis is defined through the geometric center and extends in a toe end to hell end direction parallel to the ground plane; a y-axis is defined through the geometric center in a crown to sole direction perpendicular to the ground plane; a z-axis is defined through the geometric center in a front to rear direction and perpendicular to the x-axis and the y-axis; a y'-axis is defined through the center of gravity in crown to sole direction and is parallel to the y-axis; an Iyy is measured as the moment of inertia about the y'-axis; a CGy is the center of gravity location along the y-axis, where the positive direction is measured towards the crown; the body further comprising a body lap joint surface defining an opening, the body lap joint surface comprising: a rear body lap joint section disposed along a perimeter of the rear section and extending from the heel end to the toe end; a crown panel sized to extend over the opening, the crown panel comprising a crown panel lap joint surface coupled to the body lap joint surface; a rear mass pad bordering at least a portion of the rear body lap joint section and having a rear mass pad upper surface adjoining an upper edge of the rear body lap joint section such that the rear mass pad forms a portion of the body lap joint surface in the rear body lap joint section; and wherein the crown panel is directly adhered to a portion of the rear mass pad.

Clause 2. The golf club head of clause 1, further comprising a toe mass pad bordering a toe end portion of the rear body lap joint section, the toe mass pad having a toe mass pad upper surface adjoining the upper edge of the rear body lap joint section such that the toe mass pad upper surface is planar with the upper surface of the rear mass pad.

Clause 3. The golf club head of clause 2, further comprising a sole mass pad which abuts the rear mass pad and toe mass pad.

Clause 4. The golf club head of clause 3, further comprising a thinned portion located in the interior cavity in the rear and toe portion of the interior cavity, the thinned portion is partially defined by the toe mass pad, sole mass pad, and rear mass pad.

Clause 5. The golf club head of clause 4, wherein the club head further an Iyy and CGy ratio which satisfies the following inequality:

$$Iyy \geq 20.275*CGy+373.46$$

Clause 6. The golf club head of clause 5, wherein the club head further comprises a hosel having an upper hosel opening configured to receive a shaft, the upper hosel opening fluidly connects the exterior of the club head to the interior of the club head such that the interior cavity can be accessed through the upper hosel opening; the club head comprises a lower recess side wall and bottom wall which define a lower recess, and a lower opening which is formed through the recess bottom wall; the lower opening provides a passageway from the exterior club head to the interior cavity; and the lower opening is configured to receive a screw, the screw threadedly engages a shaft sleeve on the tip of the shaft to secure the shaft to the club head, the shaft sleeve is located within the internal cavity of the club head and allows for adjustment of at least one of a loft and lie of the club head.

Clause 7. The golf club head of clause 5, wherein the club head comprises a removable weight on the sole having a weight center of gravity; the weight center of gravity is positioned within 0.3 inch of a rear skirt of the club head.

Clause 8. The golf club head of clause 5, wherein the upper edge of the rear body lap joint section and the rear mass pad upper surface are disposed below the body center of gravity.

Clause 9. The golf club head of clause 6, wherein the club head further comprises a heel mass pad located between the hosel and the rear mass pad.

Clause 10. The golf club head of clause 6, wherein the rear mass pad forms at least 0.15 squared inches of a total rear lap joint surface area.

Clause 11. A golf club head comprising: A body comprising a crown, a sole, a toe, a heel, a front, a rear, a center of gravity, and a strike face comprising a geometric center; wherein: a loft plane is defined tangent to the strike face at the geometric center; a ground plane is defined tangent to the sole when the body is in an address position; a loft angle is defined by the loft plane and the ground plane; the loft angle is in a range of 15 degrees to 35 degrees; an x-axis is defined through the geometric center and extends in a toe end to heel end direction parallel to the ground plane; a y-axis is defined through the geometric center in a crown to sole direction perpendicular to the ground plane; a z-axis is defined through the geometric center in a front to rear direction and perpendicular to the x-axis and the y-axis; a y'-axis is defined through the center of gravity in crown to sole direction and is parallel to the y-axis; an Iyy is measured as the moment of inertia about the y'-axis; a Cgy is the location of the center of gravity about the y'-axis; a skirt defined by the transition between the crown and the cole, the skirt extending from the heel, around the rear, to the toe, wherein the skirt forms a perimeter of the golf club head; an opening at least partially in the crown, configured to receive a crown panel; the opening being defined by a lap joint edge on a lap joint surface; the lap joint surface is offset from an exterior surface of the golf club head, wherein the crown panel adheres to the lap joint surface, closing the opening; a rear mass pad formed in the interior sole and rear and a toe mass pad formed in the interior sole and toe; and the rear mass pad and the toe mass pad form a portion of the lap joint surface in which the crown panel is directly coupled to.

Clause 12. The golf club head of clause 11, wherein the crown panel comprises a composite material.

Clause 13. The golf club head of clause 12, further comprising a sole mass pad which abuts the rear mass pad and toe mass pad.

Clause 14. The golf club head of clause 13, further comprising a thinned portion located in the interior cavity in the rear and toe portion of the interior cavity, the thinned portion is partially defined by the toe mass pad, sole mass pad, and rear mass pad.

Clause 15. The golf club head of clause 14, wherein the club head further an Iyy and CGy ratio which satisfies the following inequality:

$$Iyy \geq 20.275*CGy+373.46$$

Clause 16. The golf club head of clause 15, wherein the club head further comprises a hosel having an upper hosel opening configured to receive a shaft, the upper hosel opening fluidly connects the exterior of the club head to the interior of the club head such that the interior cavity can be accessed through the upper hosel opening; the club head comprises a lower recess side wall and bottom wall which define a lower recess, and a lower opening which is formed through the recess bottom wall; the lower opening provides a passageway from the exterior club head to the interior cavity; and the lower opening is configured to receive a screw, the screw threadedly engages a shaft sleeve on the tip of the shaft to secure the shaft to the club head, the shaft sleeve is located within the internal cavity of the club head and allows for adjustment of at least one of a loft and lie of the club head.

Clause 17. The golf club head of clause 15, wherein the club head comprises a removable weight on the sole having a weight center of gravity; the weight center of gravity is positioned within 0.3 inch of a rear skirt of the club head.

Clause 18. The golf club head of clause 15, wherein the upper edge of the rear body lap joint section and the rear mass pad upper surface are disposed below the body center of gravity.

Clause 19. The golf club head of clause 16, wherein the rear mass pad follows a contour of the club head.

Clause 20. A golf club head comprising: a body, a crown, a sole, a toe, a heel, a front, a rear, a center of gravity, and a strike face on the front end comprising a geometric center; a body center of gravity wherein: a loft plane is defined tangent to the strike face at the geometric center; a ground plane is defined tangent to the sole when the body is in an address position; a loft angle is defined by the loft plane and the ground plane; the loft angle is in a range of 15 degrees to 35 degrees; an x-axis is defined through the geometric center and extends in a toe end to hell end direction parallel to the ground plane; a y-axis is defined through the geometric center in a crown to sole direction perpendicular to the ground plane; a z-axis is defined through the geometric center in a front to rear direction and perpendicular to the x-axis and the y-axis; a y'-axis is defined through the center of gravity in crown to sole direction and is parallel to the y-axis; an Iyy is measured as the moment of inertia about the y'-axis; a Cgy is the located of the center of gravity the body further comprising a body lap joint surface defining an opening, the body lap joint surface comprising: a rear body lap joint section disposed along a perimeter of the rear section and extending from the heel end to the toe end, the rear body lap joint section comprising a rear body lap joint edge; a heel body lap joint section extending upwardly from the rear body lap joint section at the heel end, the heel body lap joint section comprising a heel body lap joint edge; a toe body lap joint section extending upwardly from the rear body lap joint section at the toe end, the toe body lap joint section comprising a toe body lap joint edge; a crown body lap joint section extending from the heel body lap joint section to the toe body lap joint section; a crown panel sized to extend over the opening, the crown panel comprising a crown panel lap joint surface coupled to the body lap joint surface; wherein the body further comprises a rear mass pad comprising a rear mass pad top surface, and a toe mass pad comprising a toe mass pad top surface; wherein the rear mass top surface, toe mass pad top surface, and rear body lap joint edge are planar and located in a periphery plane; the periphery plane has a first angle measured between the periphery plane and the z-axis in a YZ plane that ranges between 8 and 10 degrees; the periphery plane has a second angle measured between the periphery plane and the X-axis in the XY plane that ranges between 87 and 89 degrees; and the periphery plane intersects an intersection point, the intersection point is the rearmost portion of the club head in a YZ plane.

What is claimed is:

1. A golf club head, comprising:

a body comprising a toe end, a heel end, a rear end, a crown, a sole, and a strike face comprising a geometric center;

a center of gravity;

wherein:

a loft plane is defined tangent to the strike face at the geometric center;

a ground plane is defined tangent to the sole when the body is in an address position;

a loft angle is defined by the loft plane and the ground plane;

the loft angle is in a range of 15 degrees to 35 degrees;

an x-axis is defined through the geometric center and extends in a toe end to the heel end direction parallel to the ground plane;

a y-axis is defined through the geometric center in a crown to sole direction perpendicular to the ground plane;

a z-axis is defined through the geometric center in a front to rear direction and perpendicular to the x-axis and the y-axis;

a y'-axis is defined through the center of gravity in crown to sole direction and is parallel to the y-axis;

an Iyy is measured as a moment of inertia about the y'-axis;

a CGy is the center of gravity location along the y-axis, where a positive direction is measured towards the crown;

the body further comprising a body lap joint surface defining an opening, the body lap joint surface comprising:

a rear body lap joint section disposed along a perimeter of a rear section and extending from the heel end to the toe end;

a crown panel sized to extend over the opening, the crown panel comprising a crown panel lap joint surface coupled to the body lap joint surface;

a rear mass pad bordering at least a portion of the rear body lap joint section and having a rear mass pad upper surface adjoining an upper edge of the rear body lap joint section such that the rear mass pad forms a portion of the body lap joint surface in the rear body lap joint section;

a toe mass pad bordering a toe end portion of the rear body lap joint section, the toe mass pad having a toe mass pad upper surface adjoining the upper edge of the rear body lap joint section such that the toe mass pad upper surface is planar with an upper surface of the rear mass pad;

a sole mass pad which abuts the rear mass pad and the toe mass pad; and wherein the crown panel is directly adhered to a portion of the rear mass pad.

2. The golf club head of claim 1, further comprising a thinned portion located in an interior cavity in a rear and a toe portion of the interior cavity, the thinned portion is partially defined by the toe mass pad, the sole mass pad, and the rear mass pad.

3. The golf club head of claim 2, further comprising an Iyy and CGy ratio which satisfies the following inequality:

$$Iyy \geq 20.275 * CGy + 373.46$$

4. The golf club head of claim 3, wherein the golf club head further comprises a hosel having an upper hosel opening configured to receive a shaft, the upper hosel opening fluidly connects an exterior of the golf club head to the interior cavity of the golf club head such that the interior cavity can be accessed through the upper hosel opening;

the golf club head comprises a lower recess side wall and a recess bottom wall which define a lower recess, and a lower opening which is formed through the recess bottom wall; the lower opening provides a passageway from the exterior of the golf club head to the interior cavity; and the lower opening is configured to receive a screw, the screw threadedly engages a shaft sleeve on a tip of the shaft to secure the shaft to the golf club head, the shaft sleeve is located within the interior cavity of the golf club head and allows for adjustment of at least one of a loft and lie of the golf club head.

5. The golf club head of claim 3, wherein the golf club head comprises a removable weight on the sole having a weight center of gravity; and the weight center of gravity is positioned within 0.3 inch of a rear skirt of the golf club head.

6. The golf club head of claim 3, wherein the upper edge of the rear body lap joint section and the rear mass pad upper surface are disposed below the center of gravity.

7. The golf club head of claim 4, wherein the golf club head further comprises a heel mass pad located between the hosel and the rear mass pad.

8. The golf club head of claim 4, wherein the rear mass pad forms at least 0.15 squared inches of a total rear lap joint surface area.

9. A golf club head comprising:

a body comprising a crown, a sole, a toe, a heel, a front, a rear, a center of gravity, and a strike face comprising a geometric center;

wherein:

a loft plane is defined tangent to the strike face at the geometric center;

a ground plane is defined tangent to the sole when the body is in an address position;

a loft angle is defined by the loft plane and the ground plane;

the loft angle is in a range of 15 degrees to 35 degrees;

an x-axis is defined through the geometric center and extends in a toe end to heel end direction parallel to the ground plane;

a y-axis is defined through the geometric center in a crown to sole direction perpendicular to the ground plane;

a z-axis is defined through the geometric center in a front to rear direction and perpendicular to the x-axis and the y-axis;

a y'-axis is defined through the center of gravity in crown to sole direction and is parallel to the y-axis;

an Iyy is measured as a moment of inertia about the y'-axis;

a Cgy is a location of the center of gravity about the y'-axis;

a skirt defined by a transition between the crown and the sole, the skirt extending from the heel, around the rear, to the toe, wherein the skirt forms a perimeter of the golf club head;

an opening at least partially in the crown, configured to receive a crown panel;

the opening being defined by a lap joint edge on a lap joint surface;

the lap joint surface is offset from an exterior surface of the golf club head, wherein the crown panel adheres to the lap joint surface, closing the opening;

a rear mass pad formed in a first portion of the sole and a portion of the rear and a toe mass pad formed in a second portion of the sole and a portion of the toe; and the rear mass pad and the toe mass pad form a portion of the lap joint surface in which the crown panel is directly coupled to.

10. The golf club head of claim 9, wherein the crown panel comprises a composite material.

11. The golf club head of claim 10, further comprising a sole mass pad which abuts the rear mass pad and toe mass pad.

12. The golf club head of claim 11, further comprising a thinned portion located in an interior cavity in the rear and toe portion of the interior cavity, the thinned portion is partially defined by the toe mass pad, sole mass pad, and rear mass pad.

13. The golf club head of claim 12, wherein the golf club head further an Iyy and CGy ratio which satisfies the following inequality:

$$Iyy \geq 20.275 * CGy + 373.46$$

14. The golf club head of claim 13, wherein the golf club head further comprises a hosel having an upper hosel opening configured to receive a shaft, the upper hosel opening fluidly connects the exterior surface of the golf club head to the interior cavity of the golf club head such that the interior cavity can be accessed through the upper hosel opening;

the golf club head comprises a lower recess side wall and a recess bottom wall which define a lower recess, and a lower opening which is formed through the recess bottom wall; the lower opening provides a passageway from the exterior surface of the golf club head to the interior cavity; and the lower opening is configured to receive a screw, the screw threadedly engages a shaft sleeve on a tip of the shaft to secure the shaft to the golf club head, the shaft sleeve is located within the interior cavity of the golf club head and allows for adjustment of at least one of a loft and lie of the golf club head.

15. The golf club head of claim 13, wherein the golf club head comprises a removable weight on the sole having a weight center of gravity; and the weight center of gravity is positioned within 0.3 inch of a rear skirt of the golf club head.

16. The golf club head of claim 13, wherein an upper edge of a rear body lap joint section and a rear mass pad upper surface are disposed below the center of gravity.

17. The golf club head of claim 14, wherein the rear mass pad follows a contour of the golf club head.

18. A golf club head comprising:

a body, a crown, a sole, a toe, a heel, a front, a rear, a center of gravity, a toe end and a heel end and a strike face on the front comprising a geometric center;

a body center of gravity wherein:

a loft plane is defined tangent to the strike face at the geometric center;

a ground plane is defined tangent to the sole when the body is in an address position;

a loft angle is defined by the loft plane and the ground plane;

the loft angle is in a range of 15 degrees to 35 degrees;

an x-axis is defined through the geometric center and extends in a toe end to the heel end direction parallel to the ground plane;

a y-axis is defined through the geometric center in a crown to sole direction perpendicular to the ground plane;

a z-axis is defined through the geometric center in a front to rear direction and perpendicular to the x-axis and the y-axis;

a y'-axis is defined through the center of gravity in crown to sole direction and is parallel to the y-axis;

an Iyy is measured as a moment of inertia about the y'-axis;

a Cgy is a located of the center of gravity about the y'-axis;

the body further comprising a body lap joint surface defining an opening, the body lap joint surface comprising:

a rear body lap joint section disposed along a perimeter of a rear section and extending from the heel end to the toe end, the rear body lap joint section comprising a rear body lap joint edge;

a heel body lap joint section extending upwardly from the rear body lap joint section at the heel end, the heel body lap joint section comprising a heel body lap joint edge;

a toe body lap joint section extending upwardly from the rear body lap joint section at the toe end, the toe body lap joint section comprising a toe body lap joint edge;

a crown body lap joint section extending from the heel body lap joint section to the toe body lap joint section;

a crown panel sized to extend over the opening, the crown panel comprising a crown panel lap joint surface coupled to the body lap joint surface;

wherein the body further comprises a rear mass pad comprising a rear mass pad top surface, and a toe mass pad comprising a toe mass pad top surface;

wherein the rear mass pad top surface, toe mass pad top surface, and rear body lap joint edge are planar and located in a periphery plane;

the periphery plane has a first angle measured between the periphery plane and the z-axis in a YZ plane that ranges between 8 and 10 degrees;

the periphery plane has a second angle measured between the periphery plane and the X-axis in a XY plane that ranges between 87 and 89 degrees; and the periphery plane intersects an intersection point, the intersection point is a rearmost portion of the golf club head in a YZ plane.

* * * * *